US011539130B2

(12) United States Patent
Nicolls et al.

(10) Patent No.: US 11,539,130 B2
(45) Date of Patent: Dec. 27, 2022

(54) 1D PHASED ARRAY ANTENNA FOR RADAR AND COMMUNICATIONS

(71) Applicant: SRI INTERNATIONAL, Menlo Park, CA (US)

(72) Inventors: Michael J. Nicolls, Portola Valley, CA (US); Daniel P. Ceperley, Sunnyvale, CA (US); Ryan C. Peterson, Fort Collins, CO (US); Bryan Klofas, San Francisco, CA (US); David Watters, Sunnyvale, CA (US); Thomas Durak, Canton, MI (US); Michael Greffen, Palo Alto, CA (US); Moyra Malone, Redwood City, CA (US); John J. Buonocore, Redwood City, CA (US)

(73) Assignee: SRI International, Menlo Park, CA (US)

( * ) Notice: Subject to any disclaimer, the term of this patent is extended or adjusted under 35 U.S.C. 154(b) by 0 days.

(21) Appl. No.: 17/169,767

(22) Filed: Feb. 8, 2021

(65) Prior Publication Data

US 2021/0167496 A1 Jun. 3, 2021

Related U.S. Application Data

(63) Continuation of application No. 15/561,682, filed as application No. PCT/US2016/026697 on Apr. 8, 2016, now Pat. No. 11,024,958.

(Continued)

(51) Int. Cl.
*H01Q 19/17* (2006.01)
*H01Q 3/26* (2006.01)
(Continued)

(52) U.S. Cl.
CPC ..... *H01Q 3/2658* (2013.01); *H01Q 3/04* (2013.01); *H01Q 5/45* (2015.01);
(Continued)

(58) Field of Classification Search
CPC .... H01Q 3/2658; H01Q 5/45; H01Q 15/0013; H01Q 19/175
See application file for complete search history.

(56) References Cited

U.S. PATENT DOCUMENTS 2,471,284 A 5/1949 Rea
2,969,542 A 1/1961 Coleman
(Continued)

FOREIGN PATENT DOCUMENTS

AU 2016246770 7/2020
EP 0919835 6/1999
(Continued)

OTHER PUBLICATIONS

Australia Office Action dated Oct. 7, 2019 for Serial No. 2016246770 filed Apr. 8, 2016 (5 pages).
(Continued)

*Primary Examiner* — Daniel Munoz
(74) *Attorney, Agent, or Firm* — Dentons US LLP

(57) ABSTRACT

A phased array antenna system has at least one trough reflector, each trough reflector having at least one phased array located at a feed point of the reflector, and an array of elements located near to a point equal to one half of a center transmission wavelength. A method of decoding a receive signal includes propagating a transmit signal through a transmit and a receive path of a phased array to generate a coupled signal, digitizing the coupled signal, storing the digitized coupled signal, receiving a signal from a target, and using the digitized coupled signal to decode the signal from the target. A method of modeling the ionosphere includes
(Continued)

transmitting measuring pulses from an incoherent scattering radar transmitter, receiving incoherent scatter from the transmitting, and analyzing the incoherent scatter to determine pulse and amplitude of the incoherent scatter to profile electron number density of the ionosphere.

17 Claims, 17 Drawing Sheets

Related U.S. Application Data

(60) Provisional application No. 62/239,993, filed on Oct. 12, 2015, provisional application No. 62/190,378, filed on Jul. 9, 2015, provisional application No. 62/167,641, filed on May 28, 2015, provisional application No. 62/144,473, filed on Apr. 8, 2015.

(51) Int. Cl.

| | |
|---|---|
| ***H01Q 25/00*** | (2006.01) |
| ***H01Q 21/28*** | (2006.01) |
| ***H01Q 5/45*** | (2015.01) |
| ***H01Q 15/00*** | (2006.01) |
| ***H01Q 3/04*** | (2006.01) |
| ***H01Q 21/08*** | (2006.01) |
| ***H01Q 21/22*** | (2006.01) |

(52) U.S. Cl.
CPC ..... *H01Q 15/0013* (2013.01); *H01Q 19/175* (2013.01); *H01Q 21/08* (2013.01); *H01Q 21/22* (2013.01); *H01Q 21/28* (2013.01); *H01Q 25/007* (2013.01)

(56) References Cited

U.S. PATENT DOCUMENTS

| | | | | |
|---|---|---|---|---|
| 3,612,845 | A | 10/1971 | Lawlor | |
| 4,500,882 | A | 2/1985 | Katagi et al. | |
| 4,769,777 | A | 9/1988 | Bittle et al. | |
| 4,780,726 | A | 10/1988 | Archer et al. | |
| 5,115,246 | A | 5/1992 | Thomas, Jr. et al. | |
| 5,130,718 | A | 7/1992 | Wu et al. | |
| 5,570,307 | A | 10/1996 | Takahashi | |
| 5,748,140 | A | 5/1998 | Schober | |
| 5,900,844 | A | 5/1999 | Hill | |
| 6,169,522 | B1 * | 1/2001 | Ma | H01Q 1/288 342/357.64 |
| 6,271,786 | B1 | 8/2001 | Huff et al. | |
| 6,320,553 | B1 | 11/2001 | Ergene | |
| 6,456,231 | B1 | 9/2002 | McEwan | |
| 6,522,210 | B1 | 2/2003 | Dvorak et al. | |
| 6,664,939 | B1 | 12/2003 | Olinyk et al. | |
| 6,862,605 | B2 | 3/2005 | Wilber | |
| 6,914,554 | B1 | 7/2005 | Riley et al. | |
| 6,933,888 | B1 | 8/2005 | Schiffmiller et al. | |
| 6,965,351 | B1 | 11/2005 | Miller et al. | |
| 7,375,676 | B1 | 5/2008 | Loberger | |
| 2003/0083063 | A1 | 5/2003 | Wang et al. | |
| 2004/0259497 | A1 | 12/2004 | Dent | |
| 2006/0132354 | A1 | 6/2006 | Beard et al. | |
| 2007/0018882 | A1 | 1/2007 | Manoogian et al. | |
| 2009/0066561 | A1 | 3/2009 | Yoshimura | |
| 2013/0147658 | A1 | 6/2013 | Burri et al. | |
| 2014/0225796 | A1 | 8/2014 | Chen et al. | |
| 2015/0279103 | A1 | 10/2015 | Naegle et al. | |
| 2016/0161604 | A1 | 6/2016 | Clark | |

FOREIGN PATENT DOCUMENTS

| | | |
|---|---|---|
| EP | 2137789 | 12/2009 |
| EP | 2637253 | 9/2013 |
| WO | WO2002031915 | 4/2002 |
| WO | WO2008114246 | 9/2008 |
| WO | WO2016164758 | 10/2016 |

OTHER PUBLICATIONS

Europe Supplementary Search Report dated Sep. 12, 2018 for Serial No. 16777378.7 filed Apr. 8, 2016 (10 pages).

Europe Office Action dated Dec. 18, 2020 for Serial No. 16777378.7 filed Apr. 8, 2016 (7 pages).

Herd et al., Advanced architecture for a low cost Multifunction Phased Array Radar, IEEE MTT-S Intern Microw Symp Dig, May 2010, pp. 676-679.

International Search Report and Written Opinion dated Jan. 3, 2019 for Application No. PCT/US2018/055812 filed Jan. 3, 2019 (6 pages).

International Search Report and Written Opinion dated Aug. 30, 2016 for Application No. PCT/2016/026697 filed Apr. 8, 2016 (11 pages).

Y. Rahmat-Samii et al. "Advanced precipitation Radar antenna: array-fed offset membrane cylindrical reflector antenna," IEEE Trans. Antennas propag., vol. 53, No. 8, pp. 2503-2515, Aug. 1, 2005.

New Zealand Office Action dated Jan. 12, 2022 in corresponding application 737041 filed Apr. 8, 2016 (4 pages).

* cited by examiner

1D PHASED ARRAY ANTENNA FOR RADAR AND COMMUNICATIONS

CROSS-REFERENCE TO RELATED PATENT APPLICATIONS

This application is a Continuation of U.S. patent application Ser. No. 15/561,682 filed 8 Apr. 2016; which is a National Phase of International Application Number PCT/US16/26697 filed 8 Apr. 2016; which claims a benefit of priority to U.S. Provisional Application Nos. 62/144,473 filed 8 Apr. 2015, 62/167,641 filed 28 May 2015, 62/190,378 filed 9 Jul. 2015, and 62/239,993 filed 12 Oct. 2015; each of which is herein incorporated by reference for all purposes.

BACKGROUND

There are several applications where low cost, large aperture, steerable and/or multi-beam antennas would be desirable. These applications include the detection of resident space objects (RSOs) with active radar, multi-input multi-output (MIMO) phased array systems, simultaneous communication between ground stations and many satellites, passive reception of transmissions from multiple satellites. Currently, much of the technology to address these needs may include 2D arrays, which are often prohibitively expensive because of the large number of elements required to fill the aperture.

For radar applications, there is no low cost solution that allows for the detection of small RSOs, defined as those objects having diameters in the 1-2 cm range. Detection of RSOs with high accuracy is desirable for satellite collision avoidance, satellite tracking, satellite launch support, satellite anomaly support, and general satellite mission operations. When a collision is predicted, ground operators can maneuver the satellite to avoid the collision. This lengthens the lifetime of the satellite and mitigates the risk of debris generating events that can lead to future collisions. With the currently commonly available systems, the routine detection and tracking of objects is limited to 10 cm and larger. Objects smaller than 10 cm may go undetected yet can still pose a significant risk to satellites. Anticipated future deployment of large constellations of satellites requires the tracking of smaller sized objects to avoid a cascading debris problem. The number of debris objects in space goes up exponentially with decreasing size. A need exists for detection of objects 2 cm or larger with a cost-effective system.

For communications applications, the planned deployment of large low earth orbit (LEO) constellations consisting of hundreds to thousands of satellites requires high bandwidth communications to enable data transfer with many satellites simultaneously. These constellations may consist of hundreds of satellites per orbital plane, tens of satellites of which could be in view to a ground station at one time. Traditional solutions focus on a large number of steerable dishes for communications, which is cost prohibitive and inefficient. There is a need for a low cost phased array solution that can communicate to tens of satellites simultaneously.

SUMMARY

One embodiment is a phased array antenna system has at least one trough reflector, each trough reflector having at least one phased array located at a feed point of the reflector, and an array of elements located near to a point equal to one half of a center transmission wavelength. Another embodiment is a method of decoding a receive signal that includes propagating a transmit signal through a transmit and a receive path of a phased array to generate a coupled signal, digitizing the coupled signal, storing the digitized coupled signal, receiving a signal from a target, and using the digitized coupled signal to decode the signal from the target.

Another embodiment is a method of modeling the ionosphere that includes transmitting measuring pulses from an incoherent scattering radar transmitter, receiving incoherent scatter from the transmitting, and analyzing the incoherent scatter to determine pulse and amplitude of the incoherent scatter to profile electron number density of the ionosphere.

DETAILED DESCRIPTION OF THE EMBODIMENTS

Figure 1:
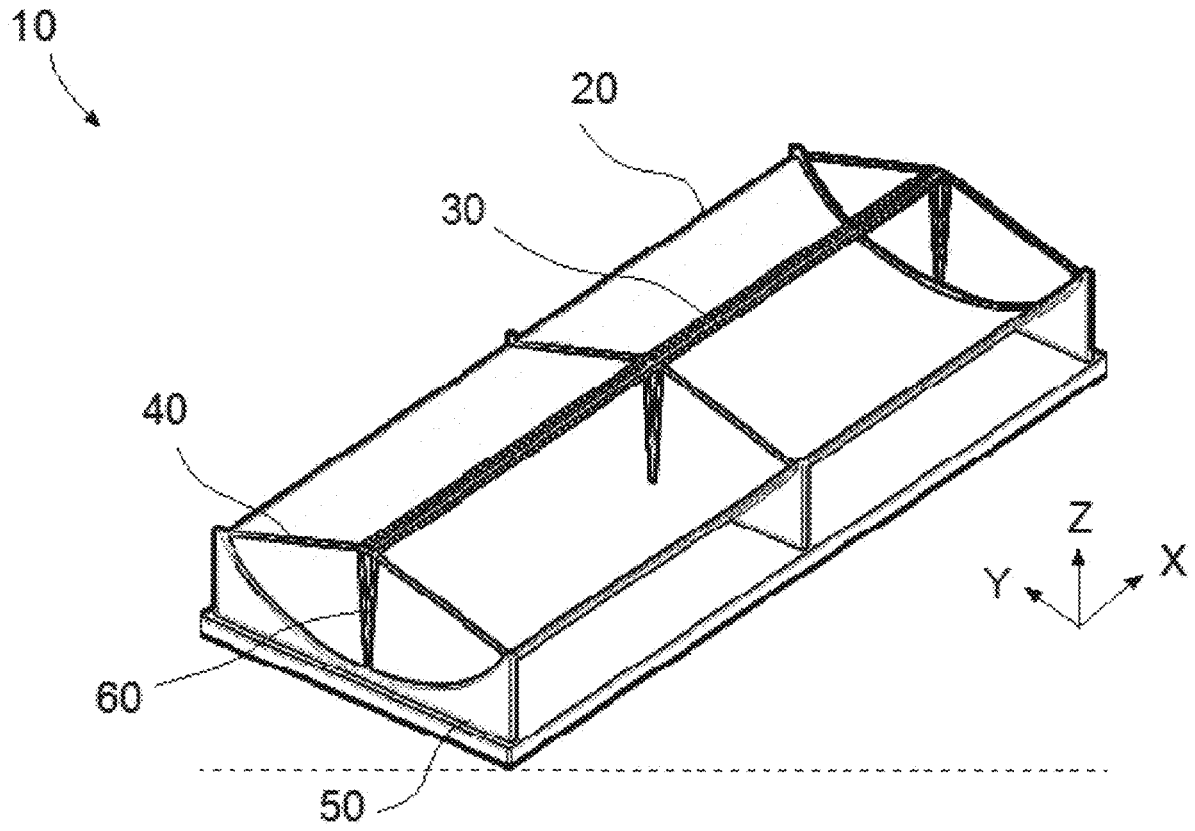
FIG. 1 shows an embodiment of a 1D phased array antenna system with a 1D phased array system and a trough reflector.

To address the needs of the radar applications described above, the approach described below consists of a low-cost 1D phased array antenna that actively illuminates debris and satellites for detection and measurement of range, Doppler, and angle. A 1D array of elements is arranged at the feed point of an elongated reflector such as a parabolic trough. This reflector concentrates the power in one direction and can be made of a metal mesh. The use of a mesh contributes to the low cost. Other suitable materials may be used as well. The concentration of power occurs mainly due to two factors. In the scanning plane the concentration results from the array focusing. In the elevation plane the concentration results from the shape of the elevation aperture of the trough.

The RF, digital and analog hardware is made from Advanced Modular Incoherent Scatter Radar (AMISR) technology, which was designed for high reliability and low cost. The low cost comes from a few different design methodologies. One in particular comes from the analog-digital hybrid architecture of the 1D phased array system. In this architecture, the digitization of the signals occurs after beam summation, which negates the need to use a digitizer for each element. Further, using the trough structure reduces the number of elements required. Typically, the reduction factor may be a square root (functionally a factor of ~8) relative to a 2D array. This contributes to a significantly lower cost solution. The trough allows the antenna to electronically steer in one dimension so that a large imaging field containing objects such as debris or satellites, as examples, can be detected.

To address the communication need, the approach similarly focuses on the use of a parabolic trough reflector with a 1D array of elements at the feedpoint. This approach may advantageously apply to the LEO constellation communications need. These constellations will consist of multiple satellites concentrated in orbital planes. The 1D scanning technology allows the operator to use multiple transmit and/or receive beams (MIMO communications) in the orbital plane. In this way the array can simultaneously communicate with many satellites, reducing or removing the need for large numbers of mechanically steerable dish antennas or expensive 2-D phased arrays. To cover the full orbital plane, the arrays will need to steer in azimuth and/or elevation and a single site may require multiple arrays.

The approach outlined above has many benefits. The 1D radar system described below lends itself to cost-effective design. This enables several applications such as but not limited to deploying multiple of these radar systems to monitor a large area of space and achieve a high revisit rate on LEO RSOs. Higher cost systems can achieve monitoring with conventional technology. Similarly, in communications, when satellite constellations deploy with multiple satellites, one or multiple 1D antenna systems can deploy to communicate simultaneously with these multiple satellites. These are only some of the advantages of the system described below.

Using multiple reflectors, each reflector having one or more phased arrays, the system can measure angles using radar or radio interferometry. In addition, the system, with one or more reflectors, can be used for monostatic radar, bistatic radar, multistatic radar, interferometry both passive and active, and communications. Monostatic radar refers to a radar in which the transmitter and receiver are collocated. In bistatic radar, the transmitter and receiver are separated. A multistatic radar system includes multiple monostatic or bistatic radars and has a shared area of coverage.

FIG. 1 shows the 1D phased array antenna system with a parabolic trough reflector 10, with the reflector 20, the array of elements 30, the base 50, and the support structures 40 and 60. The support structures 40 and 60 while providing mechanical support may also provide conduits for electric wiring to power the individual elements of the 1D array. One should note that this discussion may refer to the 1D phased array antenna system with the trough reflector as a '1D phased array system', the '1D system' or the 'system.'

While the embodiment of FIG. 1 shows a parabolic trough, the system may use other appropriate shapes such as but not limited to cylindrical, hyperbolic, toroidal, and catenary. The trough reflector may consist of any suitable material, depending on frequency, such as but not limited to metal mesh, expanded metal, metallized foam, and metallized sheets. In general, the mesh aperture size, the size of the holes within the mesh, may be significantly smaller than the operating wavelength of the radar.

Small aperture mesh provides high reflectivity and low leakage. Signal leakage through the mesh increases antenna backlobe and system temperature. Antenna backlobe refers to radiation of energy from the antenna in the opposite direction of the main radiation direction. Increasing backlobe reduces the antenna energy radiating in the main direction. Large aperture mesh is lower cost, lighter weight, and has reduced wind loading. The mesh aperture design would consider such factors. Further, painting the mesh may protect the material from weathering. White paint reflects sunlight from the trough surface thereby minimizing thermal deformations of the structure. The materials and the methods used for constructing the trough reflector can help to lower the cost of the 1D phased array system.

The dimensions of the trough reflector are chosen appropriately for the applications. One application would track LEO objects around 10 cm in diameter with a UHF trough. If the elements have a peak power of 500 Watts and a 10% duty cycle, a system temperature of 150 K, and an integration time of about 100 ms, an appropriate trough would have a length of approximately 45 meters. This corresponds to approximately 128 elements at half-wavelength spacing, with a 13 m parabolic aperture.

Figure 2:
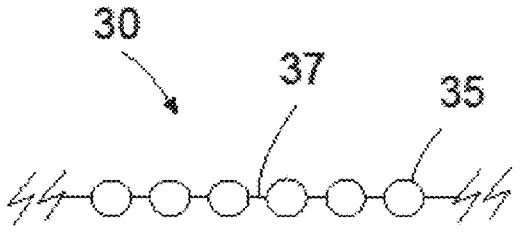
FIG. 2 shows an embodiment of one section of a 1D phased array.

As shown in FIG. 1, an array of elements 30 is located at the feed point of the trough reflector. FIG. 2 illustrates a section of this array. The array may consist of multiple elements such as 96, 128 or other suitable number. One element in the array, such as 35, may be mounted with other elements on a support structure 37. The drawing shows the elements as circles only for convenience. The shape, and form factor of the elements are appropriately designed for the application.

Figure 3:
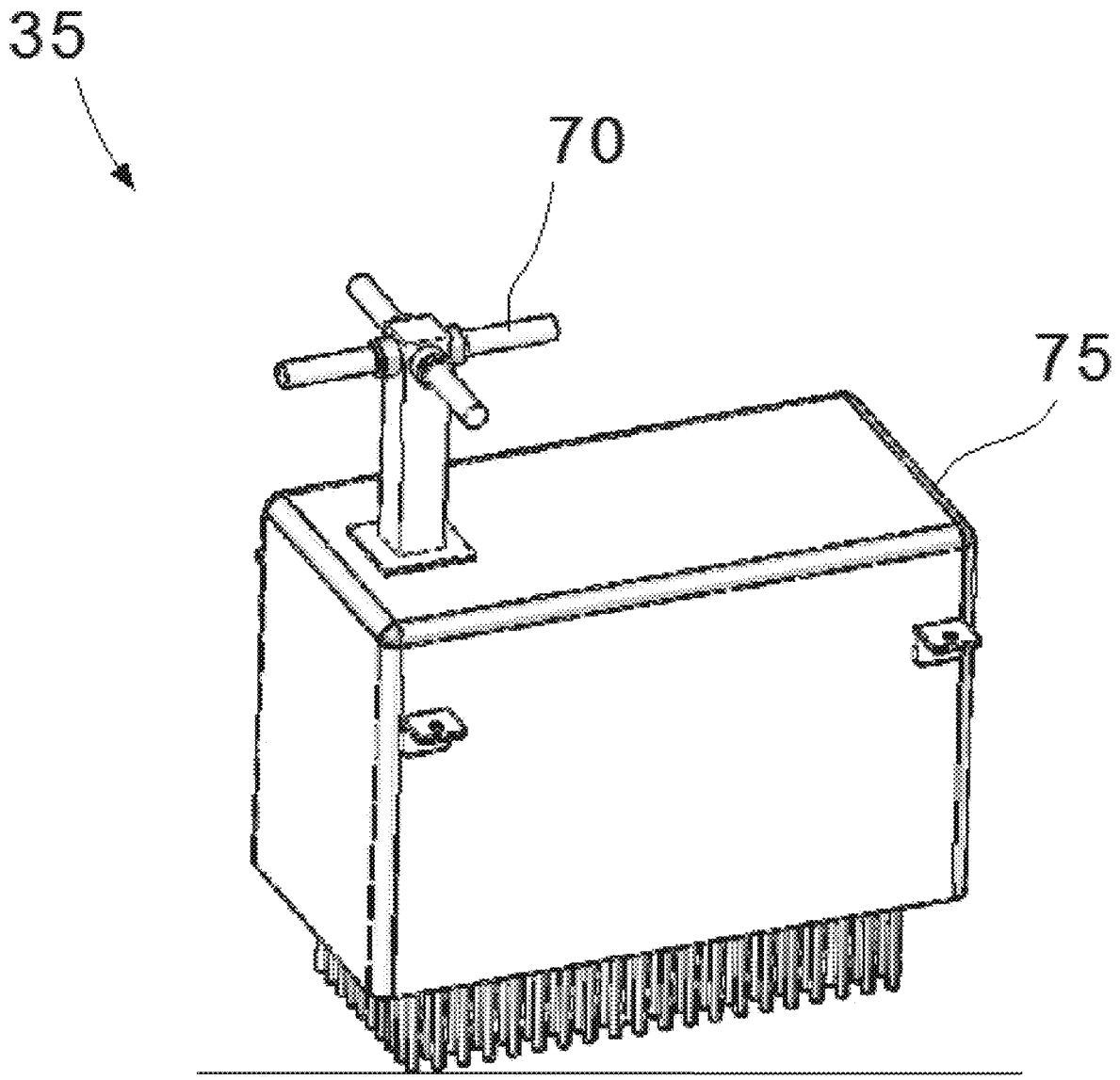
FIG. 3 shows an embodiment of one element of a 1D phased array.

FIG. 3 shows an example element from the AMISR UHF technology, with a cross-dipole antenna 70. The transmit, receive electronics for this example element may reside with the housing 75. The antenna pattern and the shape of the housing may differ from that shown in the figure, depending on many factors including frequency and the application as examples. Referring back to FIG. 1, with the array of elements as shown one may obtain beam steering in the X-dimension or azimuth direction.

The presence of grating lobes may limit steering angles. Grating lobes occur when the spacing of individual elements in an array is equal to or greater than half the wavelength. Similarly, the location of the grating lobes depends on the inter-element spacing and the frequency of the signal. To maximize the steering angle, the elements may be spaced close to a half-wavelength. With this configuration, a single array of elements can scan the X-Z plane. Elevation angle diversity may be achieved in multiple ways and will be described further below.

While not shown in the figure, the base of the entire reflector structure may be movable. The need for a movable base might arise, for example, in a communications system due to the need to track a single orbital plane as it precesses across the sky from revolution to revolution. A movable base then allows the satellites in the given orbital plane to remain in the scanning plane of the ID phased array system. A system of motors and actuating mechanisms under control of a control system may provide the motion of the base. With this control system, the amount and type of motion may be calculated based on a number of situations such as but not limited to the projected path of a satellite or of other objects. The projected path can be calculated based on measurements or other data and by using an orbit model.

The system can impart many different types of motion. These may include but are not limited to azimuth, elevation, and tilt. As described earlier, the 1D trough antenna has a reflector 20. This reflector may consist of various materials including aluminum, steel, a metal mesh or a metallized foam pad, as examples. These materials may be chosen based on a number of factors including cost of materials, cost of fabrication and for what specific applications the trough antenna is designed, as examples. As an example, if the antenna resides on a movable base, a lighter material may be chosen. The lighter materials may include aluminum, cast magnesium or the metal mesh, as examples. This may reduce the requirements on the size and capacity of the actuators that move the base.

Figure 4:
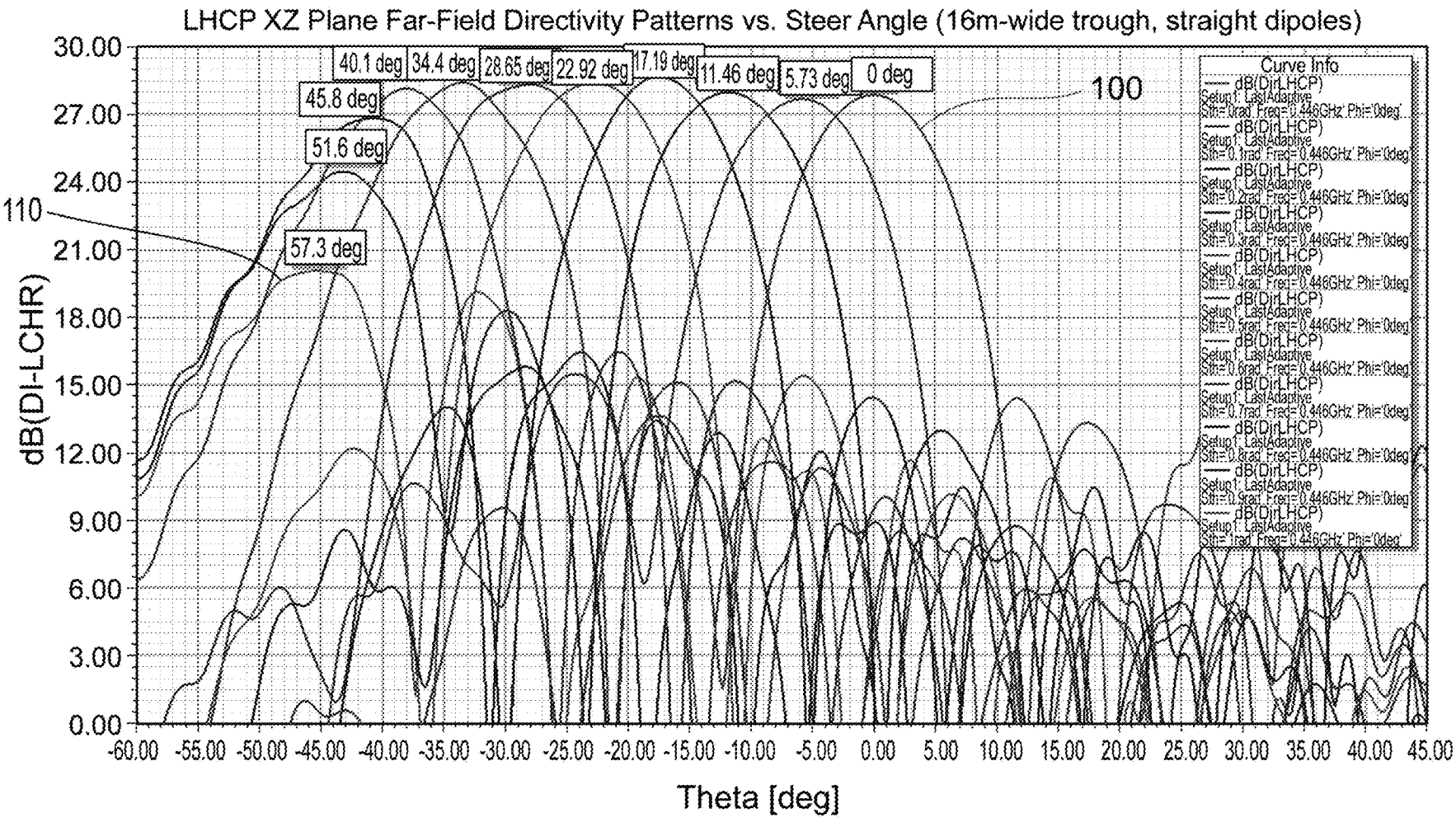
FIGS. 4 and 5 show an illustration of a far field directivity pattern of a scanning 1D phased array.
Figure 5:
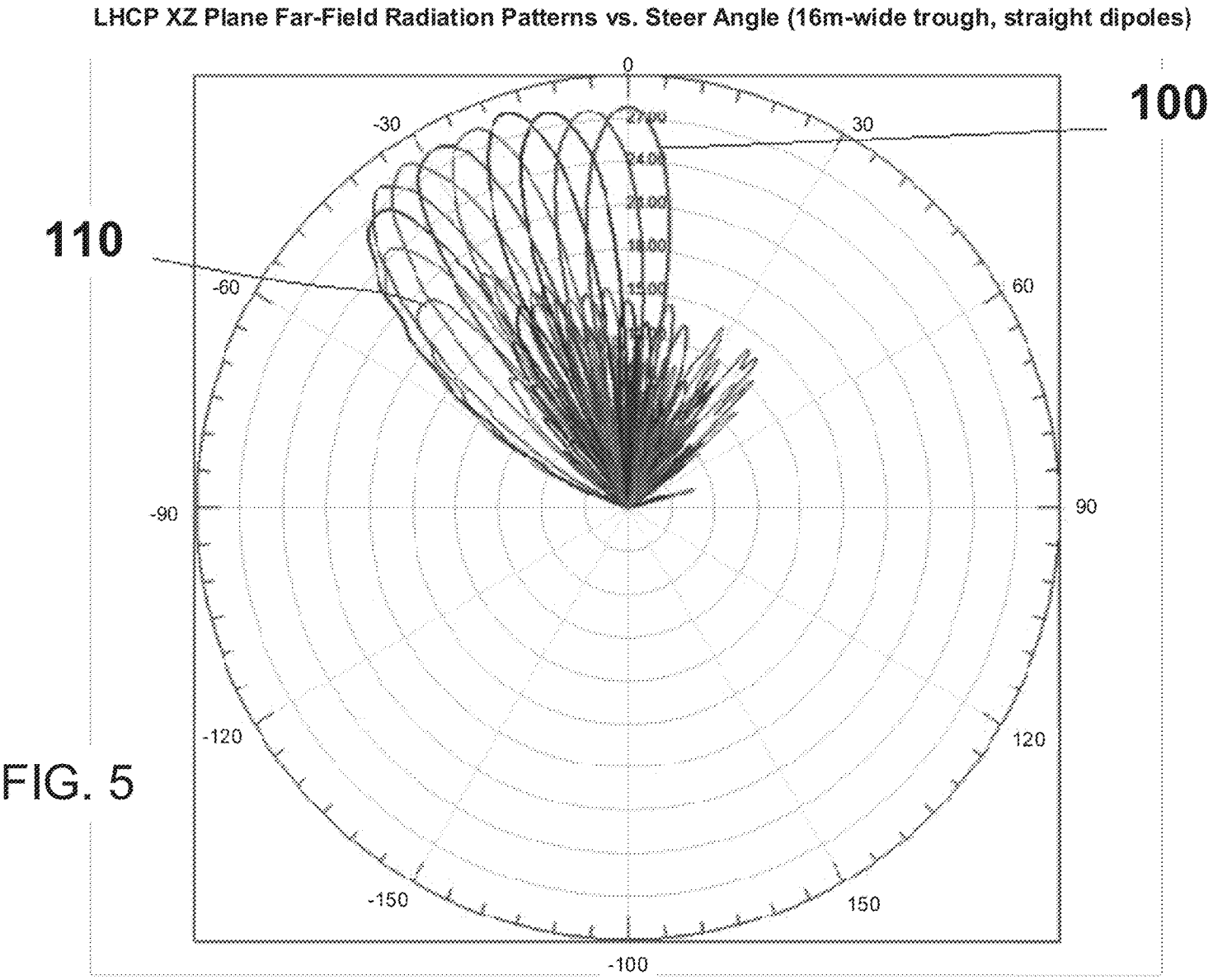
Figure 6:
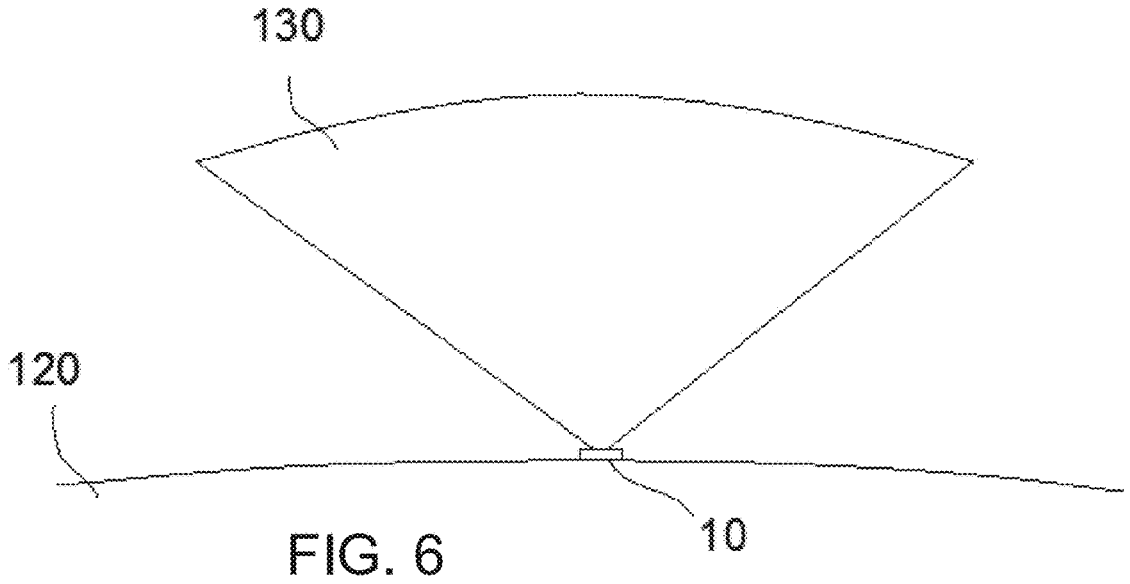
FIG. 6 shows an illustration of an imaging field-of-view

FIGS. 4 and 5 illustrate example directivity and radiation patterns from a 1D parabolic trough system. This embodiment consists of 9 transmit elements operating at 446 MHz with an element spacing of 0.37 meters, illuminating a 16-meter long trough with a parabolic aperture of 13 meters. FIG. 4 illustrates the XZ plane far field directivity plane. The various curves illustrate the directivity pattern for different beam steering angles. For example, curve 100 illustrates the directivity pattern for a beam steered at 0° whereas curve 110 illustrates the beam at 57.3°. FIG. 5 illustrates the same information in a polar plot, except this plot illustrates the steering of the beam. These two figures illustrate that with the set of parameters chosen for this example, the beam may be steered +/−about 60°. FIG. 6 illustrates how this steering may be utilized to cover the imaging field. In this figure, a section of the earth is shown as 120. The imaging field of the 1D system is shown as 130. The 1D system can sweep this area in transmit and receive operation by adjusting the phases for each element.

Figure 7:
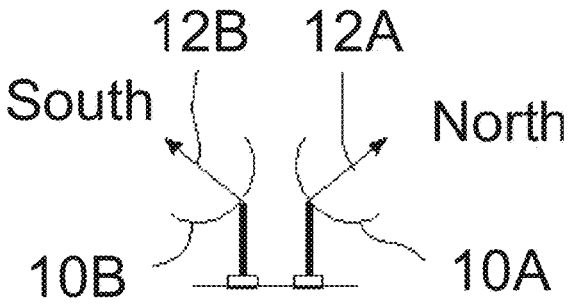
FIG. 7 shows an embodiment of two 1D phased array antenna systems pointing at different directions.

Multiple 1D systems may deploy to scan multiple sections of the sky, with multiple possibilities for configurations. In one configuration, two 1D systems may be located and oriented in such a way that they point to different directions in the sky. As an example, two 1D systems could reside at the same ground location, with one system pointing northwards and the other pointing southwards with the scanning direction in the east-west plane. FIG. 7 illustrates the orientation of such a combined system.

Figure 8:
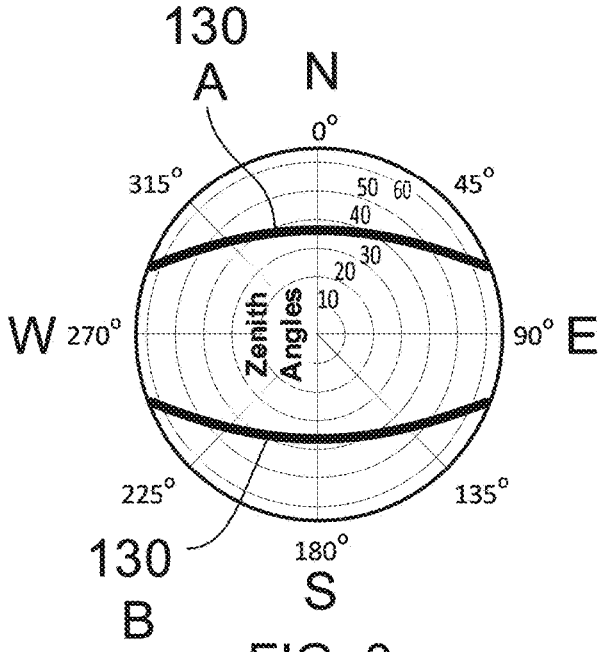
FIG. 8 shows an embodiment of a projection of the imaging field-of-view on the sky.

In this figure, 10A and 10B are 1D systems oriented in a northward and southward direction respectively. Arrows 12A and 12B indicate the scanning plane with the plane going perpendicularly into the plane of the paper. FIG. 8 shows the angular plot of the sky looking upwards and curves 130A and 130B indicate the angular extent of the imaging field corresponding to the 1D phased array systems 10A and 10B respectively, projected on the angular plot.

Figure 10:
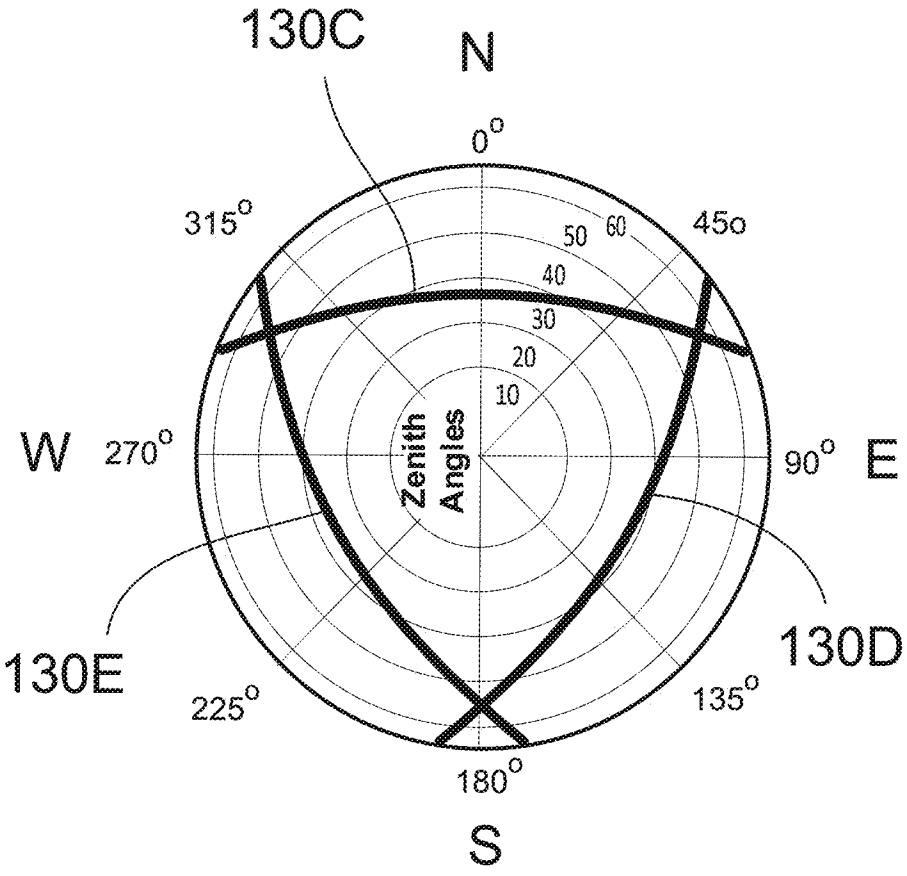
FIG. 10 shows an embodiment of a projection of the imaging field-of-view on the sky.
Figure 9:
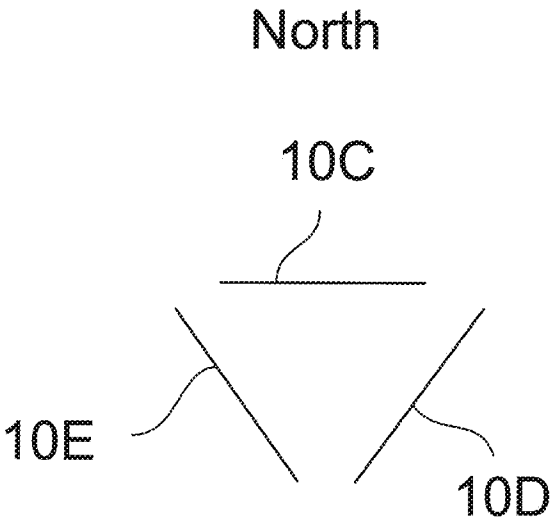
FIG. 9 shows an embodiment of a configuration of three 1D phased array antenna systems.

FIG. 9 illustrates another configuration. In this embodiment, three 1D systems deploy with one pointing north 10C, another pointing southeast I0D and a third pointing southwest 10E. FIG. 10 illustrates a plot with the angular extent of the scans as curves 130C, 130D and 130E. As a note, the lines 130A-130E curve due to the projection of the straight line onto the angular plot. One can imagine these plots as spheres and the curves show where the scanning planes intersect with the sphere.

With these examples, one can now understand how to create a 'space fence.' In other words, the 1D systems are arranged in such a manner to detect any object above a certain size, flying in certain orbits in the patch of space above the systems. The configuration of FIGS. 7 and 8 can detect objects flying on north south orbits. However, with this configuration objects flying due east-west or west east may go undetected, and other inclinations might result in a detection by only one of the systems.

The configuration of FIGS. 9 and 10 mitigates these issues as objects flying in any orbit may be detected. In addition, the configuration may provide at least two observations of the object. This allows an appropriate choice depending on the requirements of detection. One should note that other angles and configurations are possible. In addition, these systems need not be co-located in one location. The systems could be placed far apart, for example, one on each pole and one on the equator. However, since the antenna can only detect spacecraft within line of sight and within its sensitivity limits, satellites or debris in low inclination orbits would not be detectable from a polar station. Therefore, multiple equatorial sites are recommended so that a low-inclination satellite can be observed multiple times per revolution.

Figure 11:
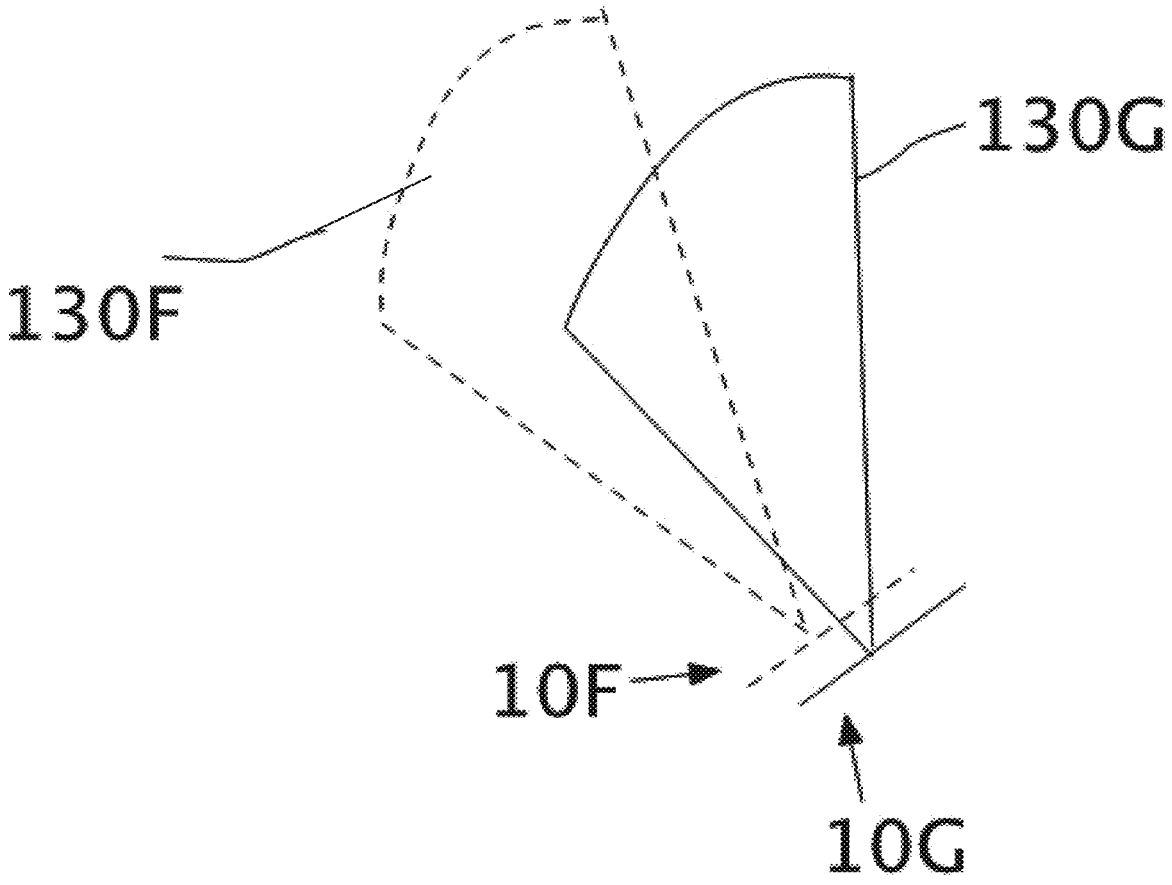
FIG. 11 shows an imaging field-of-views.

Multiple ID-systems may also be used to achieve elevation angle diversity. This may be achieved by arranging the systems 10G and 10F at an angle to each other and to the XY plane. The scanning plane would then point at different elevation angles with different fields of view 130G and 130F as shown in FIG. 11.

A movable base enables changes to the position of the 1D system as described above. In a further concept, the 1D system may include mechanisms that allow adjustment of orientation. Referring to FIG. 1, the base 50 may move by a system of gears, motors or other types of actuators, not shown in the figure. As an example, the mechanisms may allow rotation of the entire system about the Z-axis. Other mechanisms may allow changing the orientation of the trough antenna. One can visualize orientation by examining one of the systems in FIG. 7.

The arrow 12A or 12B would point at a different angle when orientation changes. In this case, the actuating mechanisms would cause the trough to point in a different direction. The ability to adjust or modify the position and orientation may have advantages in many situations. In one example, modifications of the shape of the fenced area may enable better detection of a target. Referring to FIG. 8, if an object flew across the sky in a mostly east-west direction with a small south-east to north-west angle so that the object and the field-of-view of the 1D system intersected very briefly or for a short period of time, one or both the 1D-systems shown in FIG. 7 may rotate around their Z-axes. The next time the object comes around, if it is circling the earth, the rotated systems may obtain a better signal.

Figure 12:
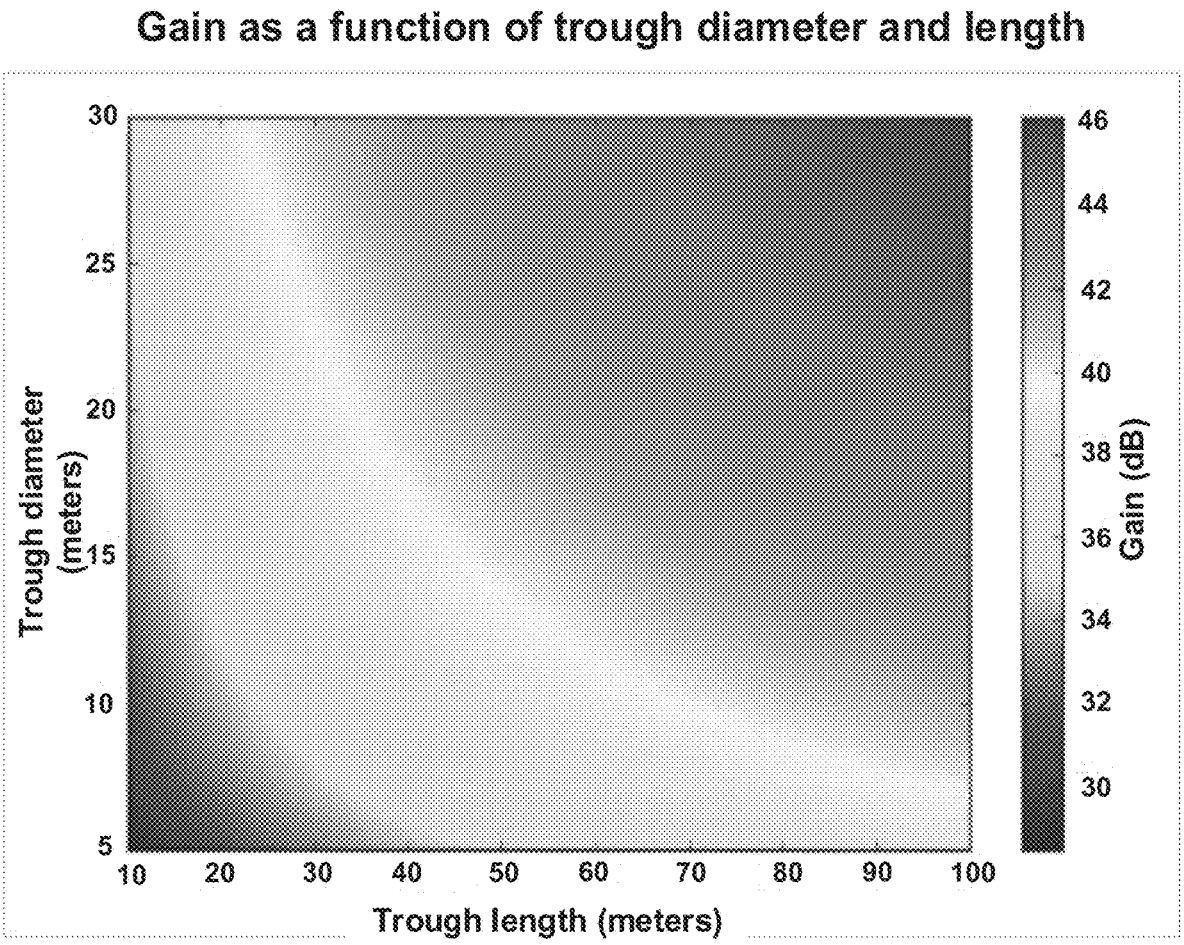
FIG. 12 illustrates gain as a function of trough length and diameter for a 1-D phased array at 446 MHz

The length and the diameter of the trough represent only a few of the many design parameters for the 1D phased array antenna system. The gain of the antenna is one factor considered when making the design choice of the length and diameter. FIG. 12 shows a calculation of the antenna gain as a function of trough diameter and length for a UHF system. It also shows that if a particular gain is desired, the diameter and the length may be varied as best suited for the environment in which the 1D system will deployed. The gain of the antenna is given by:

$$G = \frac{4\pi}{\lambda^2} A_{eff} \qquad \text{Eqn. 1}$$

where Δ is the radar wavelength, and $A_{eff}$ is the effective aperture, given by:

$$A_{eff}=\varepsilon D_{length}D_{width} \quad \text{Eqn. 2}$$

where $D_{width}$ and $D_{length}$ are the width and length of reflector and c is the aperture efficiency.

The required trough size for a radar application is determined by a number of factors, including the detectability of the target. The received power is given by:

$$P_{rx} = \frac{P_{tx}G_{tx}G_{rx}\sigma_{rcs}\lambda^2}{(4\pi)^3 R_{tx}^2 R_{rx}^2 L} \quad \text{Eqn. 3}$$

where $P_{tx}$ is the transmit power, $G_{tx}$ is the transmit gain, $G_{rx}$ is the receive gain, arcs is the radar-scattering cross-section, A is the radar wavelength, $R_{tx}$ is the transmit range to the target, $R_{rx}$ is the receive range to the target, and L is a loss factor. The required integration time to achieve a given signal-to-noise ratio (SNR) is:

$$T_{int} = \frac{F_{safety}k_B T_{sys}}{F_{duty}P_{rx}} \quad \text{Eqn. 4}$$

where $k_B$ is Boltzmann's constant, $T_{sys}$ is the system temperature, and $F_{duty}$ is the system duty cycle, and $F_{safety}$ is a detectability safety margin.

Conversely, the minimum detectable RCS for a radar is given by:

$$\sigma_{rcs} = \frac{(4\pi)^3 R_{tx}^2 R_{rx}^2 L}{P_{tx}G_{tx}G_{rx}\lambda^2}\frac{F_{safety}k_B T_{sys}}{F_{duty}T_{int}}. \quad \text{Eqn. 5}$$

Mapping the RCS to a physical object size depends on the object scattering properties, material, and many other factors. For a spherical conducting sphere, one can assume Rayleigh scattering if the object circumference, $C_{obj}=2\pi R_{obj}$ is less than approximately 0.1λ. In this regime, the RCS to object size relationship for a spherical conducting sphere is given by:

$$\sigma_{rcs} = \frac{64}{9}A_{obj}\left(\frac{C_{obj}}{\lambda}\right)^4 \quad \text{Eqn. 6}$$

where $A_{obj}$ cross-sectional area of the target. For an object circumference greater than 0.1λ, the RCS can be treated using Mie scattering and the RCS is more difficult to predict. For very large objects, the RCS approaches the optical crosssection ($A_{obj}$). Given a desired minimal detectable cross-section at the desired range, as well as the desired integration time, the system parameters can be computed.

Figure 13:
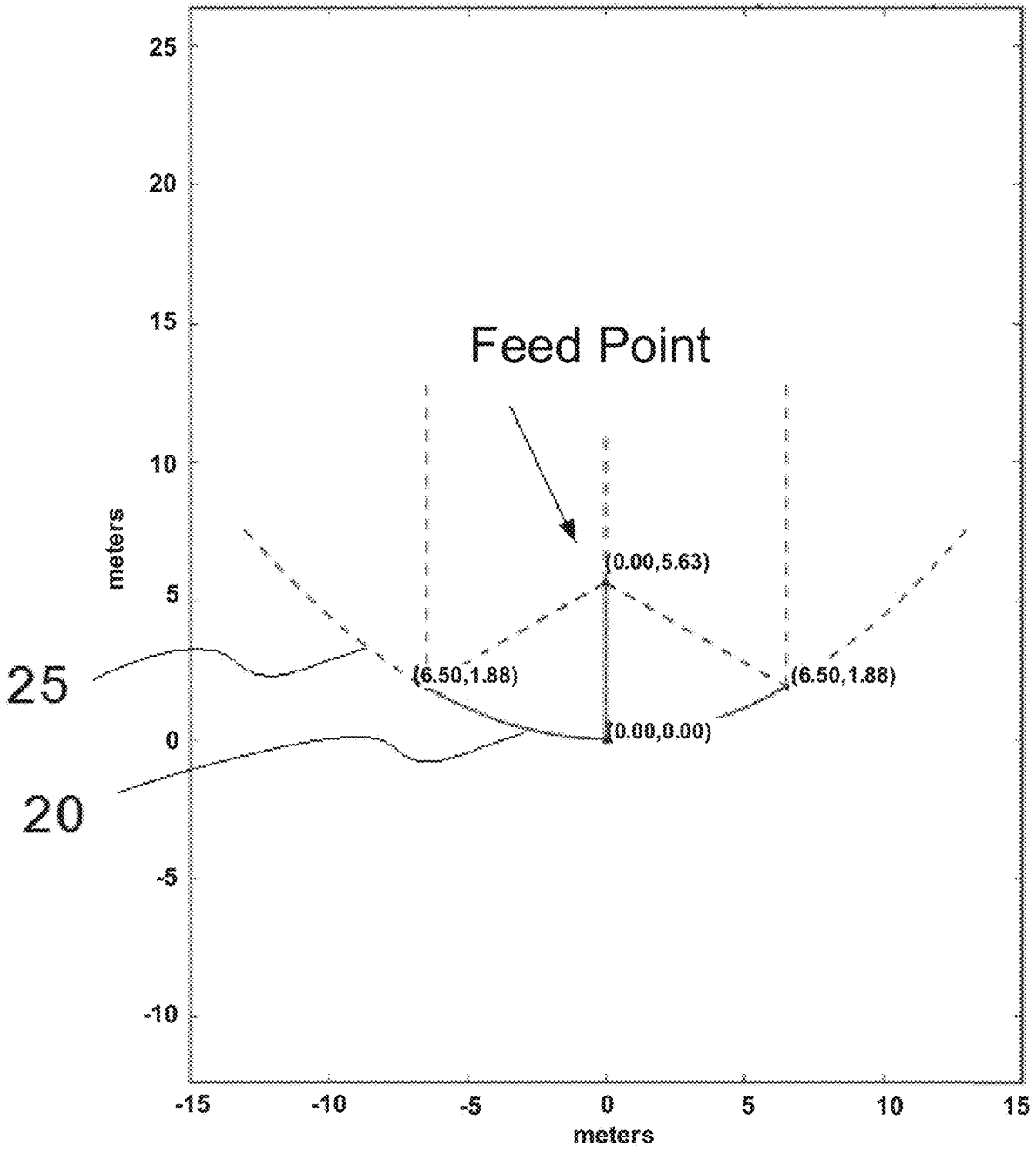
FIG. 13 illustrates one embodiment of a trough reflector and a 1D phased array system.

FIG. 13 illustrates an example of a trough geometry. The trough 20, shown as a solid line, is seen to be part of a parabolic arc 25, shown as a dashed line. The feed point is indicated. This is where the elements of the 1D array may be located, going into the plane of the paper. In this particular example, the feed point is located at 5.63 m above the lowest point of the parabola. The angle from the feed point the edge of the trough is 60°. The depth of the dish in this case is 1.88 m. These numbers are dependent on the beam pattern of the element.

A sub-reflector may offer additional advantages to the trough design. This is an additional reflector that may be located between the feed and the main trough. It may be used to redirect, focus, or spread the radio frequency energy traveling between the feed and the main trough. Using the sub-reflector antenna gain and sidelobe levels may be further optimized. It may also reduce the cost to service the feed because the feedpoint can be located closer to ground level. Furthermore, the orientation of the feed antenna equipment can be adjusted to make installing and servicing easier, and so that gravity-fed moisture drainage holes do not interfere with electronics or ground planes.

Table 1 below illustrates example configurations of a 1D system as described above.

| | Units | UHF System with 500 Watt/10% duty Elements, for detecting 10 cm objects at 1500 km range | UHF System with 1 KiloWatt/20% duty Elements, for detecting 10 cm objects at 1500 km range | L-band System with 500 Watt/20% duty Elements, for detecting 1 cm objects at 1500 km range | S-band System with 100 Watt/20% duty Elements, for detecting 2 cm objects at 1500 km range | L-band System with 500 Watt/20% duty Elements, for detecting 10 cm objects at 1500 km range | S-band System with 100 Watt/20% duty Elements, for detecting 1 cm objects at 1500 km range |
|---|---|---|---|---|---|---|---|
| Object Characteristics | | | | | | | |
| Object diameter | m | 0.1000 | 0.1000 | 0.0200 | 0.0200 | 0.0100 | 0.0100 |
| Object circumference | m | 0.3142 | .3142 | 0.0628 | 0.0628 | 0.0314 | 0.0314 |
| Object cross-sectional area | m2 | 0.0079 | 0.0079 | 0.0003 | 0.0003 | 0.0001 | 0.0001 |
| Range to target | m | 2.E+06 | 2.E+06 | 2.E+06 | 2.E+06 | 2.E+06 | 2.E+06 |
| Max integration time | seconds | 0.2000 | 0.2000 | 0.2000 | 0.2000 | 0.2000 | 0.2000 |
| General Characteristics | | | | | | | |
| Frequency | Hz | 5.E+08 | 5.E+08 | 1.E+09 | 3.E+09 | 1.E+09 | 3.E+09 |
| Wavelength | m | 0.67 | 0.67 | 0.23 | 0.1 | 0.23 | 0.1 |
| Object RCS | m2 | 0.01 | 0.01 | 0.00 | 0.00 | 0.00 | 0.00 |
| Object RCS | dBsm | −21.05 | −21.05 | −35.03 | −35.03 | −41.05 | −41.05 |
| Element power | Watts | 500.00 | 1000.00 | 500.00 | 100.00 | 500.00 | 100.00 |
| Element duty cycle | | 0.10 | 0.20 | 0.20 | 0.20 | 0.20 | 0.20 |

-continued

| | Units | UHF System with 500 Watt/10% duty Elements, for detecting 10 cm objects at 1500 km range | UHF System with 1 KiloWatt/20% duty Elements, for detecting 10 cm objects at 1500 km range | L-band System with 500 Watt/20% duty Elements, for detecting 1 cm objects at 1500 km range | S-band System with 100 Watt/20% duty Elements, for detecting 2 cm objects at 1500 km range | L-band System with 500 Watt/20% duty Elements, for detecting 10 cm objects at 1500 km range | S-band System with 100 Watt/20% duty Elements, for detecting 1 cm objects at 1500 km range |
|---|---|---|---|---|---|---|---|
| Element spacing | meters | .033 | 0.33 | 0.12 | 0.05 | 0.12 | 0.05 |
| Aperture efficiency | | .50 | 0.50 | 0.50 | 0.50 | 0.50 | 0.50 |
| Tsys | Kelvin | 150.00 | 150.00 | 100.0 | 100.00 | 100.00 | 100.00 |
| Detectability safety margin | | 20.00 | 20.00 | 20.00 | 20.00 | 20.00 | 20.00 |
| 1-D phased array system | | | | | | | |
| Width (trough) | meters | 13.0000 | 13.0000 | 13.0000 | 13.0000 | 13.0000 | 13.0000 |
| Number of elements req'd | | 147 | 93 | 298 | 510 | 473 | 809 |
| Peak power | KiloWatts | 73.50 | 92.60 | 149.01 | 50.96 | 236.54 | 60.89 |
| Trough length | meters | 49.00 | 30.87 | 34.39 | 25.48 | 54.59 | 40.45 |
| 2D array | | | | | | | |
| Number of elements req'd | | 1690 | 1065 | 6952 | 20759 | 11036 | 32953 |
| Peak power | KiloWatts | 845.24 | 1064.94 | 3475.97 | 2075.94 | 5517.75 | 3295.35 |
| Array linear dimension | meters | 13.71 | 10.88 | 9.62 | 7.20 | 12.12 | 9.08 |

For the same object characteristics and for the same general characteristics such as frequency, for a given power-aperture product. Power-aperture product measures the performance of radars. The table compares a trough array and a 2D array. From this table, it can be seen that for a 500 Watt UHF system, for an object with diameter of 10 cm, given the same power-aperture product, the 1D system has a trough length of 49 m and a width of 13 m compared to a linear dimension of 13.71 m for the 2D array. However, the number of elements required in the 1D system is 147 compared to 1690 for the 2D array. This illustrates the cost advantage of the ID-system.

Figure 14:
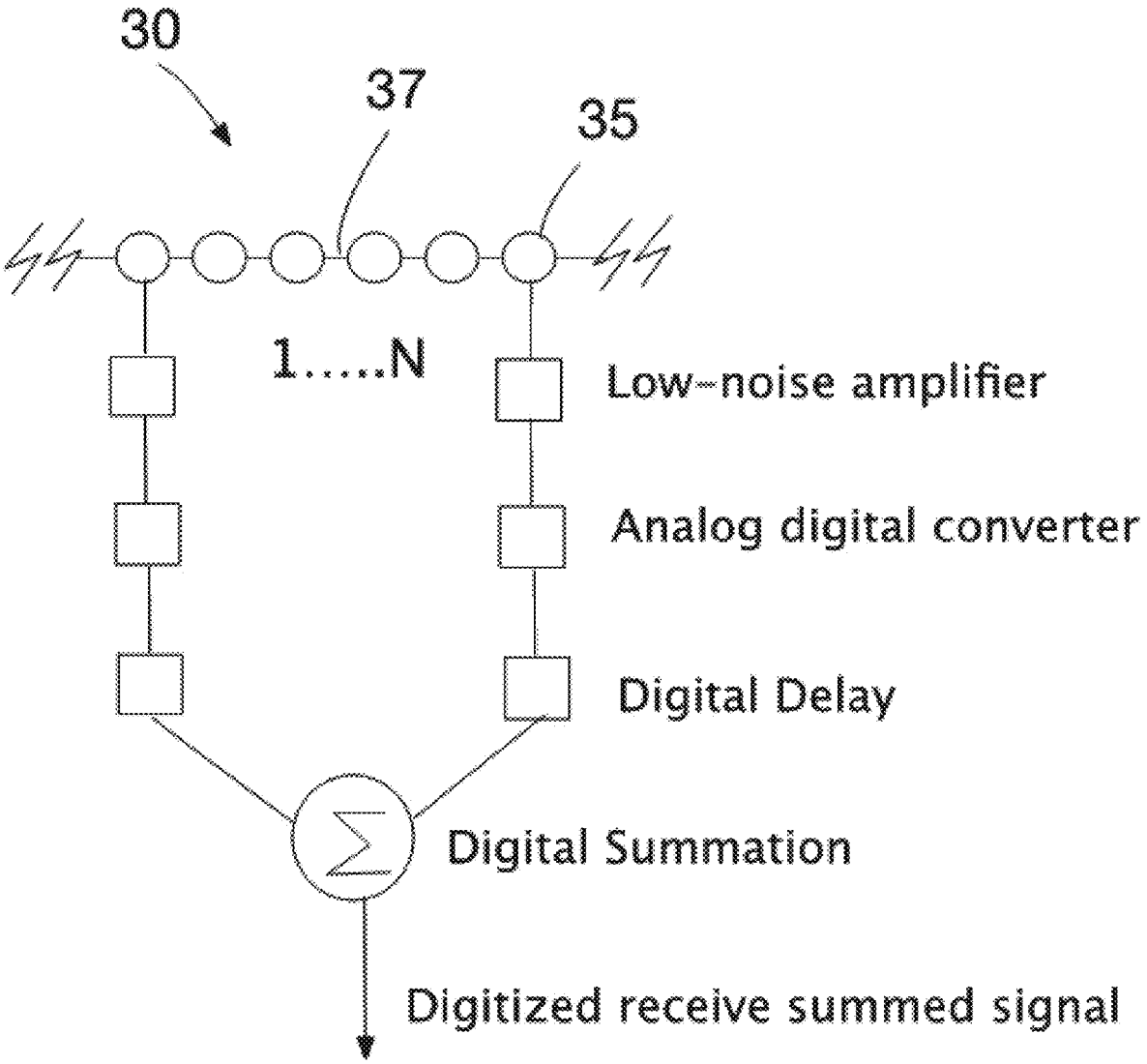
FIG. 14 illustrates one embodiment of a digital beamformer architecture.
Figure 15:
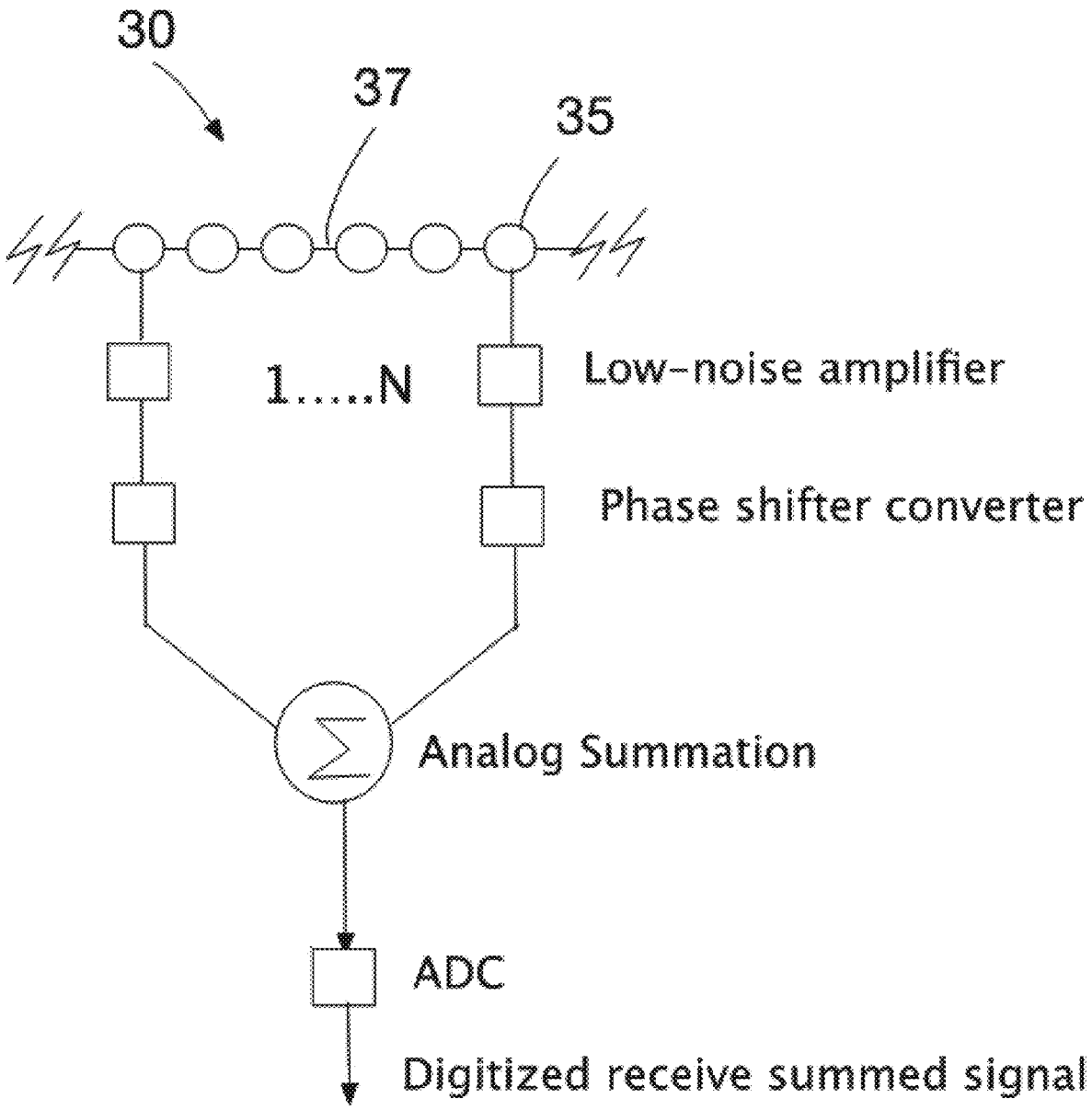
FIG. 15 shows one embodiment of an analog beamformer architecture.
Figure 16:
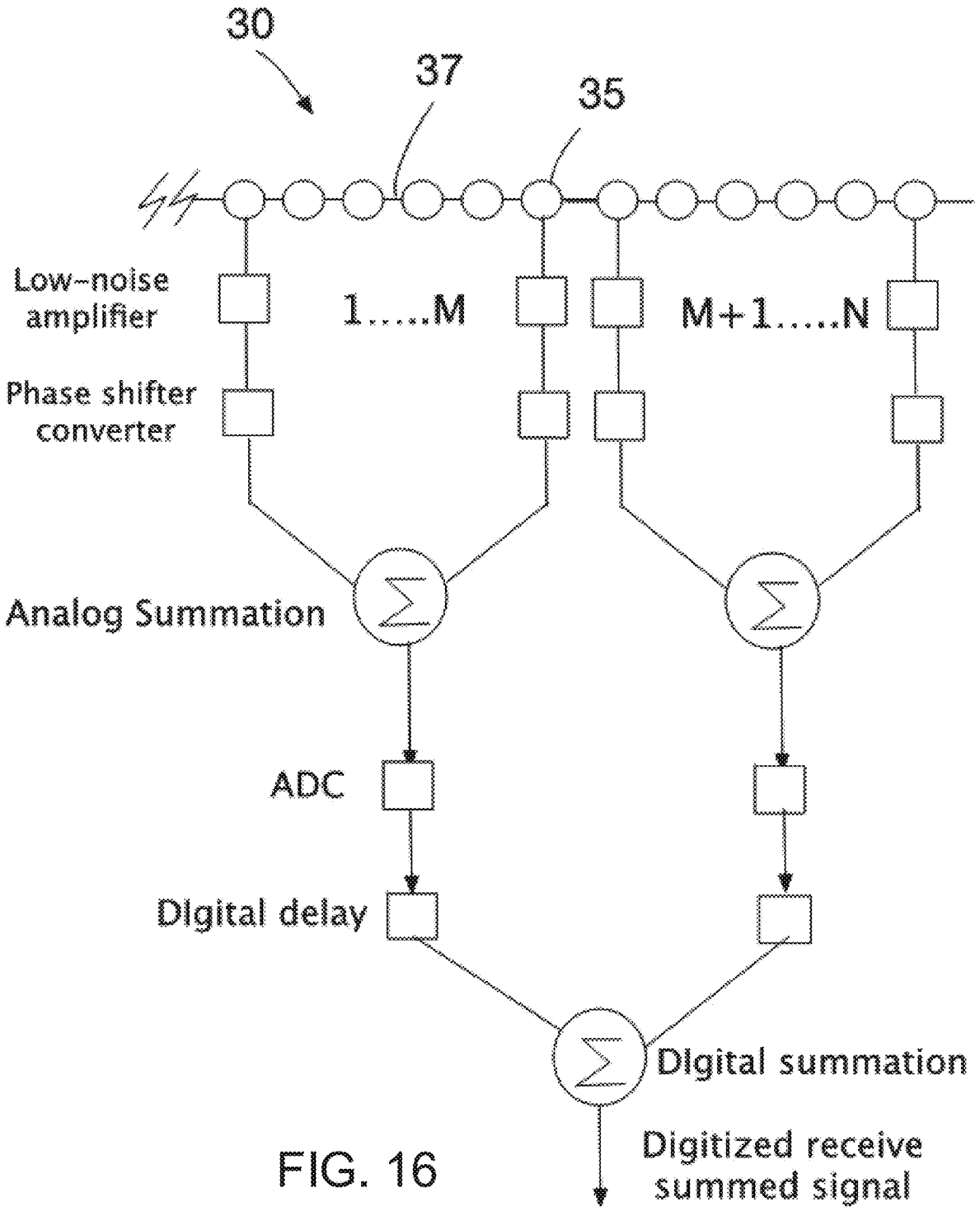
FIG. 16 shows an embodiment of a hybrid beamformer architecture.

FIGS. 14-16 show some examples of receiver beamformer architectures. Beamformer architectures are well known and understood. FIG. 14 is the most general configuration, where the signals from N elements are amplified and digitized, and fed into an N-channel beamformer functionally consisting of a digital delay and summation. While attractive, this solution may be prohibitively expensive for commercial applications because the beamformer requirements might be excessive, for example requiring 2 GHz bandwidth over 1000 channels.

FIG. 15 shows an alternative solution of an analog beamforming approach. In this embodiment, every signal is amplified then sent to a phase shifter bank and summed, producing an N-channel analog stream. The signal is then digitized. This configuration requires fewer digitizers. FIG. 16 illustrates a hybrid approach where groups of channels, 1 to M in the example, are summed. The partial sums are then digitized to form a total sum. Each configuration has its own advantages and disadvantages in terms of cost, power usage and beamformer precision. These are well known in the literature and will not be described here. Additionally, while the figures describe the receive signal path, the transmit signal path is similar and will not be repeated here.

Coherent processing is a technique to improve signal to noise ratio (SNR) which increases detectability for radar applications. The bandwidth of the transmitted waveform determines the range resolution for a radar. For phase-coded waveforms, where a pulse is phase coded with $N_{baud}$ number of "bauds" spaced every $T_{baud}$ seconds, where the total pulse length is $T_{pulse}=N_{baud}T_{baud}$, the range resolution is given by $cT_{baud}/2$ where c is the speed of light. While this is the fundamental resolution over which the radar can resolve, interpolation can be used to improve the statistical range measurement accuracy to greater than 10 times this value, in the case of high SNR returns.

While the range measurements from individual pulses can be "incoherently" averaged, or fit with an orbital model, to improve the statistics of measurements as the $\sqrt{N_{int}}$ where $N_{int}$ is the number of incoherent integrations, coherent processing can be instead applied which increases the statistics of measurements as $N_{int}$. To achieve this, multiple pulses can be combined coherently assuming that the target amplitude is stationary over the integration time. Coherent summation refers to summing being done in the complex domain where phases are preserved, as opposed to incoherent summation where summing is done after magnitude detection.

In a first sequence where the transmitters transmit 'Pulse 1', 'Pulse 2', 'Pulse 3' and so on. After Pulse 1 is transmitted, the reflected signal, Signal 1, is received at a target. Similarly, a signal, Signal 2, comes back after Pulse 2 is transmitted. The receive signal may be quite weak and close to the noise floor. In this case, Signal 1 and Signal 2 may be coherently summed to improve SNR.

To explain this concept mathematically, if the transmitted waveform is given by:

$$e(t)=\epsilon(t)e^{i\omega_0 t} \quad \text{Eqn. 7}$$

where e(t) is the slow-time varying complex envelope of the transmission and $\omega_0$ is the radian carrier frequency. The received signal is modeled by:

$$z(t) = bx\left(t - \frac{2R}{c}\right)e^{i\omega_D t} \quad \text{Eqn. 8}$$

corresponding to a scaled (b) delayed time (t−2R/c), Doppler shifted ($\omega_D$) version of the received signal as discussed in "Real-Time Space Debris Monitoring with EISCAT," *Advances in Space Research*, vol. 35, no. 7, pp. 1197-1209, 2005. Additional levels of complexity can be added to this model. For example, if the Doppler shift itself varies with time, then this can be modeled as shown in the reference.

Estimation of the received signal can be accomplished by simply convolving the received signal, z(t), with a delayed time, Doppler shifted representation of the transmit waveform. Therefore:

$$\hat{s}(t) = \int_0^T z(t)x\left(t - \frac{2R}{c}\right)e^{i\omega_D t}dt \quad \text{Eqn. 9}$$

where ŝ(t) is the estimated receive signal. While most applications treat T as the pulse length ($T_{pulse}$), it can equally be several pulses so long as coherency is maintained. In this matter, multiple pulses can be coherently decoded, accounting for the Doppler shift of the received waveforms. Equation 9 can be discretized and written as a discrete Fourier transform. The estimated signal can be computed over all resolvable frequencies using a Fast Fourier Transform algorithm. In this way, multiple targets in the field-of-view but at different Doppler shifts can be discerned.

Long coherent integration times have the advantage of increasing Doppler resolution. The Doppler resolution is determined by 1/T in the above equation. Coherent processing increases SNR and significantly improves Doppler resolution.

In another consideration, coherent integration produces a large advantage over limited time intervals as long as the signals from the targets remain coherent. Changes in the system's viewing angle, satellite orientation (rotation), or the state of the ionosphere cause returns to lose coherence. This reduced coherence reduces the effectiveness of coherent integration algorithms. A scheme that combines short coherent integration intervals with longer incoherent integration intervals often yields optimal system performance. Several types of incoherent integration of operations may be done. As an example, the summation may be carried out after detection or the power from each channel may be summed.

As mentioned above, the radar resolution is determined by the transmit bandwidth. In conventional radar systems, frequency chirps are often used to provide this bandwidth broadening. However, the performance of these systems is limited by the presence of clutter and interference, and frequency chirps have an inherent range-Doppler ambiguity. Randomization of the transmit pulse parameters provides an advantageous technique to overcome some of these issues, especially if multiple targets over a wide range of altitudes are being tracked. The pulse length ($T_{pulse}$) the interpulse time ($T_{ipp}$) can be randomized, occasionally called aperiodic coding. In addition, the baud length ($T_{baud}$) described earlier can also be randomized.

To explain this a bit further, a statistical property of pseudorandom sequences is that they are orthogonal. For two pseudorandom sequences this can be mathematically written as:

$$\langle S_1(t)|S_2(t)\rangle = 0 \quad \text{Eqn. 10}$$

Randomized pulse sequences make use of this statistical property to reduce or eliminate ambiguous self-clutter from unwanted ranges. In one example, randomized pulse sequences may be used to detect objects at different altitudes. In a string of pulses which have been randomized, one pulse may be used for a low earth orbit object detection whereas the combination of many pulses may be treated as a longer pulse sequence for geosynchronous equatorial orbit (GEO) object detection (which are at higher altitudes).

In another example, each pulse can have a unique random sequence so that when the receive signals from one transmit pulse are decoded, signals from other pulses do not clutter the signals from the first pulse, and essentially get randomized into noise. When multiple targets are present in the field-of-view at the same time, a conventional radar may not discriminate between the two. However, using randomization of the pulse with unique sequences, it becomes possible to identify where the receive signals originated from.

In another example, randomization of the $T_{ipp}$ using aperiodic sequences would be advantageous for high altitude targets. This is because the detection of targets that are at high altitudes (e.g., GEO) typically takes 100 s of milliseconds, over which several pulses are transmitted. By randomizing the IPP, one is essentially randomizing the transmit pulse using "0"s, transmitter off-times, limited by the transmitter inter-pulse period (IPP), essentially transmitting an exceptionally long pulse with good coherency properties. These "0"s, if periodically repeated, provided Doppler ambiguity determined by the Fourier transmission of the transmission waveform. Randomizing $T_{ipp}$, reduces these ambiguities and therefore reduces the likelihood of false or biased detections from noise. In addition, one could randomize radar waveforms.

The combination of an electronically scanned phased array and coherent processing leads to the ability to track multiple objects simultaneously with good range and Doppler resolution. For example, 10 objects can be tracked simultaneously with a UHF system with an estimated object coherency time of 100 ms, with a Doppler resolution of 10 Hz (3.35 m/s at UHF). The object would remain in the beam for 5 s and the time spent per object would be 500 ms. The number of coherent range and Doppler estimates would be 5 while the object is in the beam.

As mentioned earlier, the transmit pulses may be sometimes coded to enhance parameters such as signal to noise ratio. These coded signals have to be decoded when they are received at the 1D system. Typically, during the decoding process, a copy of the intended transmit waveform is used. However, using the copy of the intended transmit waveform may result in unsatisfactory levels of artifacts due to improper decoding. This is because the actual transmit waveform emanating from the individual elements may be different that the intended waveform due to distortions in phase, amplitude, and timing. It is advantageous to use the actual transmit waveform for the decoding process.

Figure 17:
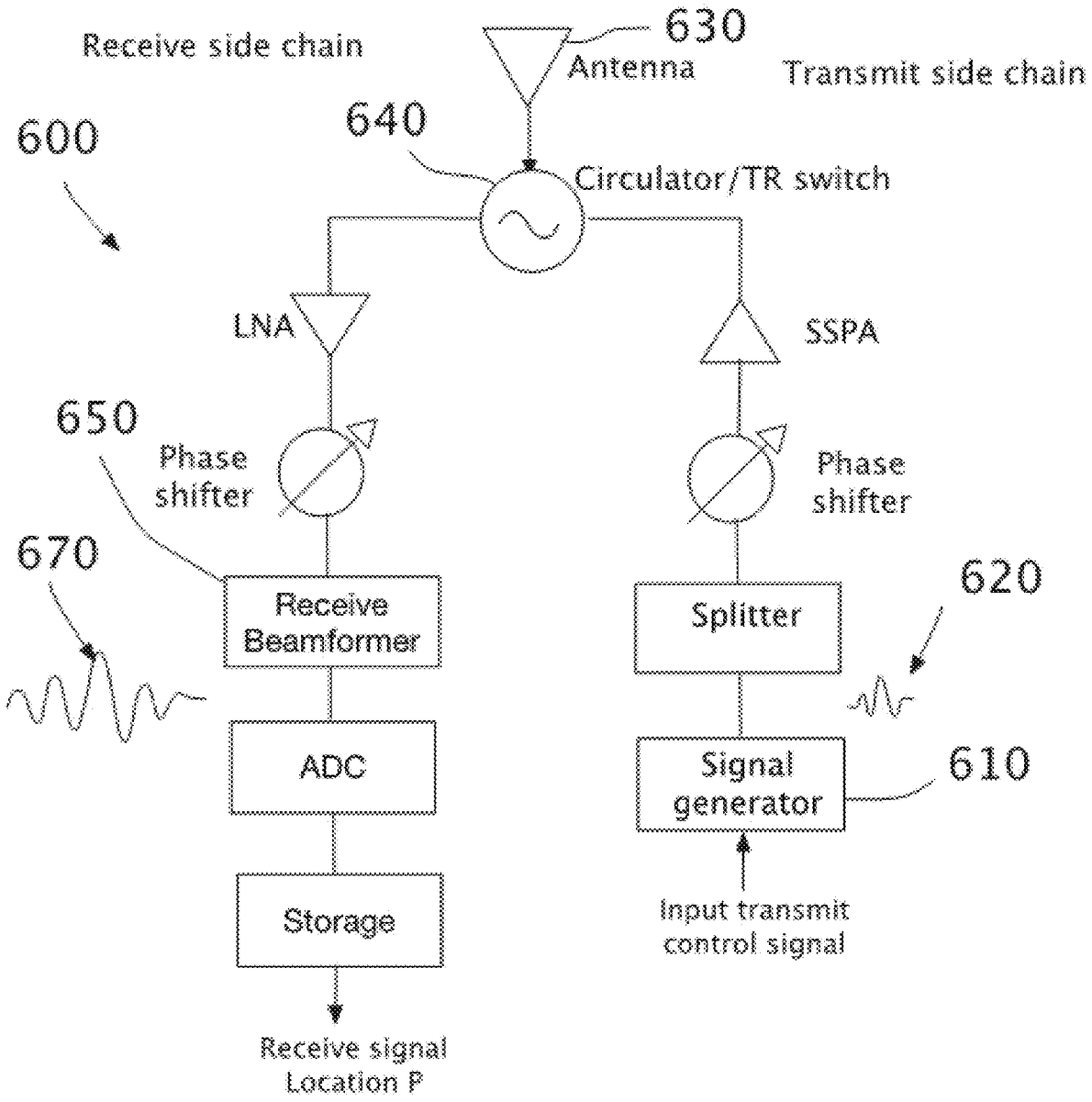
FIG. 17 shows an embodiment of the use of a transmit signal for decoding.

FIG. 17 illustrates this concept. This figure shows some of the functional processing blocks of the transmit/receive system. An example of an intended transmit signal 620 is shown at the output of the signal generator 610. As this signal propagates through to the antenna 630 and is transmitted, it will undergo further magnitude and phase changes.

After transmission, the signal travels to the target and reflects back to the antenna. The receiver electronics, which may include a processor executing instructions, processes this signal. As shown, the signal at the output of the receive beamformer 670 may be different in magnitude and phase compared to the intended transmit signal 620.

Using the intended waveform to decode the receive signal may lead to artifacts. To avoid these artifacts, a signal that is propagated through the transmit and receive functional blocks but not propagated into free space is used. This signal results from leaks caused by the circulator or the transmit/receive switch 640 designed with some coupling. During the transmit operation, some amount of signal couples from the transmit side to the receive side. This coupled signal is then digitized and stored and used for decoding the receive signals from the target.

Inverse Synthetic Aperture Radar (ISAR) is a technique for imaging an object, such as a piece of debris or a spacecraft, with multiple radar systems. These images can identify the object, especially if it is large, and improve the ability to link measurements taken by one radar with measurements taken at another radar. The quality of the image formed using the ISAR technique is dependent on the satellite motion and signal bandwidth. The images formed using this technique are two dimensional, with one axis pointed along the axis of the trough and the other axis pointed in the range direction away from the trough. The best image resolution is achieved when the radar can view the object from horizon to horizon, and when the radar has a very wide bandwidth. The use of the 1D system with inter-element spacing less than or equal to $\lambda/2$ is advantageous in this case as it allows the use of steered beams; this improves the time that a target is visible to the 1D system thus enabling the formation of ISAR images.

Figure 18:
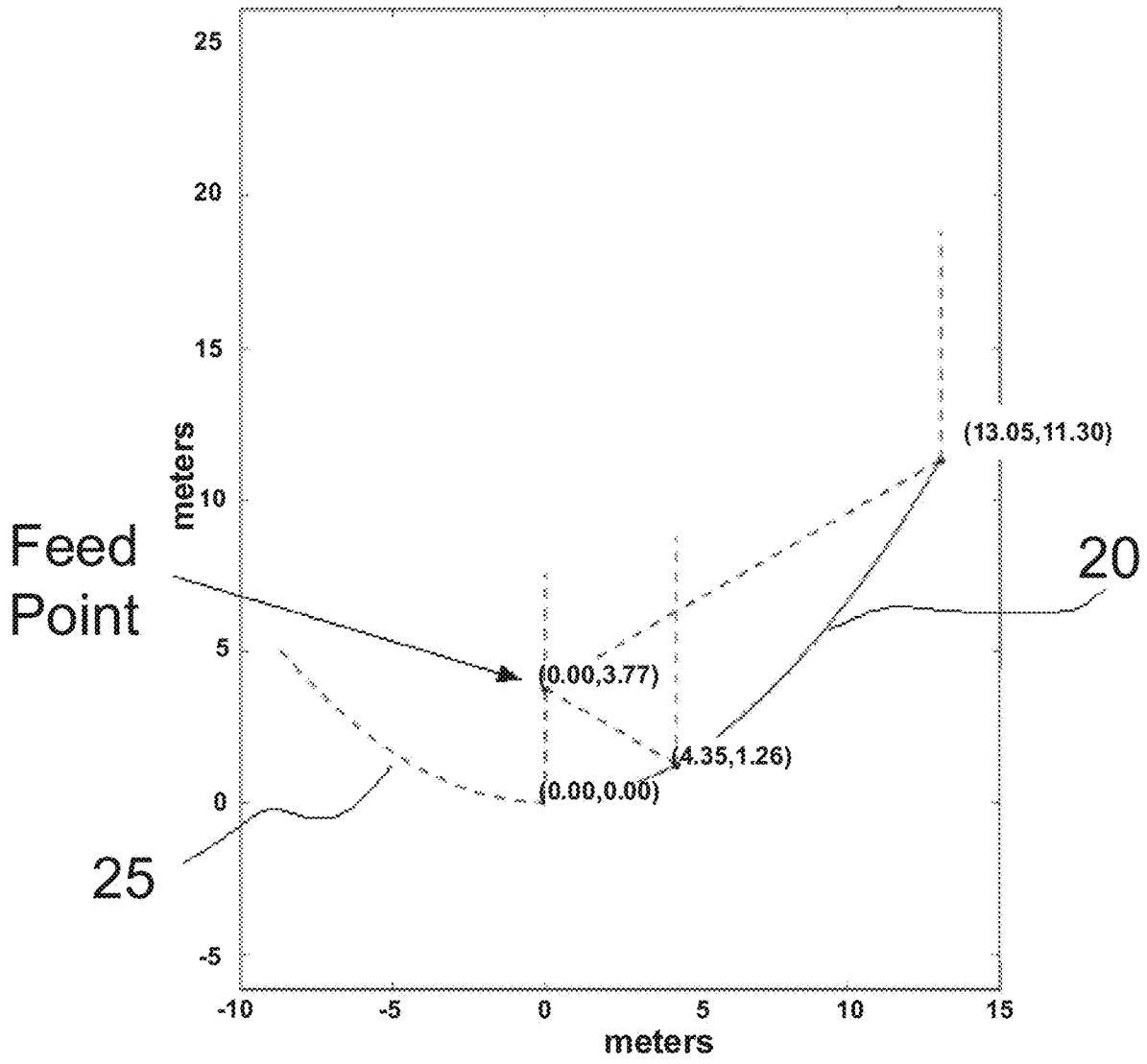
FIGS. 18 and 19 show embodiments of offset reflectors.

FIG. 18 illustrates an example trough geometry. The feedpoint is seen approximately 5 m directly above the lowest point of the trough and approximately 6 m away from the edge of the dish. In may be difficult to have physical access to the feedpoints without special equipment. In addition to the issue of access, having the feedpoint directly above the trough increases blockage of the signals in the main part of the beam. In FIG. 18, another configuration is shown which overcomes these issues. Here the feed point is located to the side of the antenna and not directly above it but still at the focal point of the parabola. In this example, the feed elements are rotated 60°, facing the trough. This results in an aperture of 13 m for the trough however as can be seen from the figure, the feed points are only about 3.7 m over the bottom of the trough.

Figure 19:
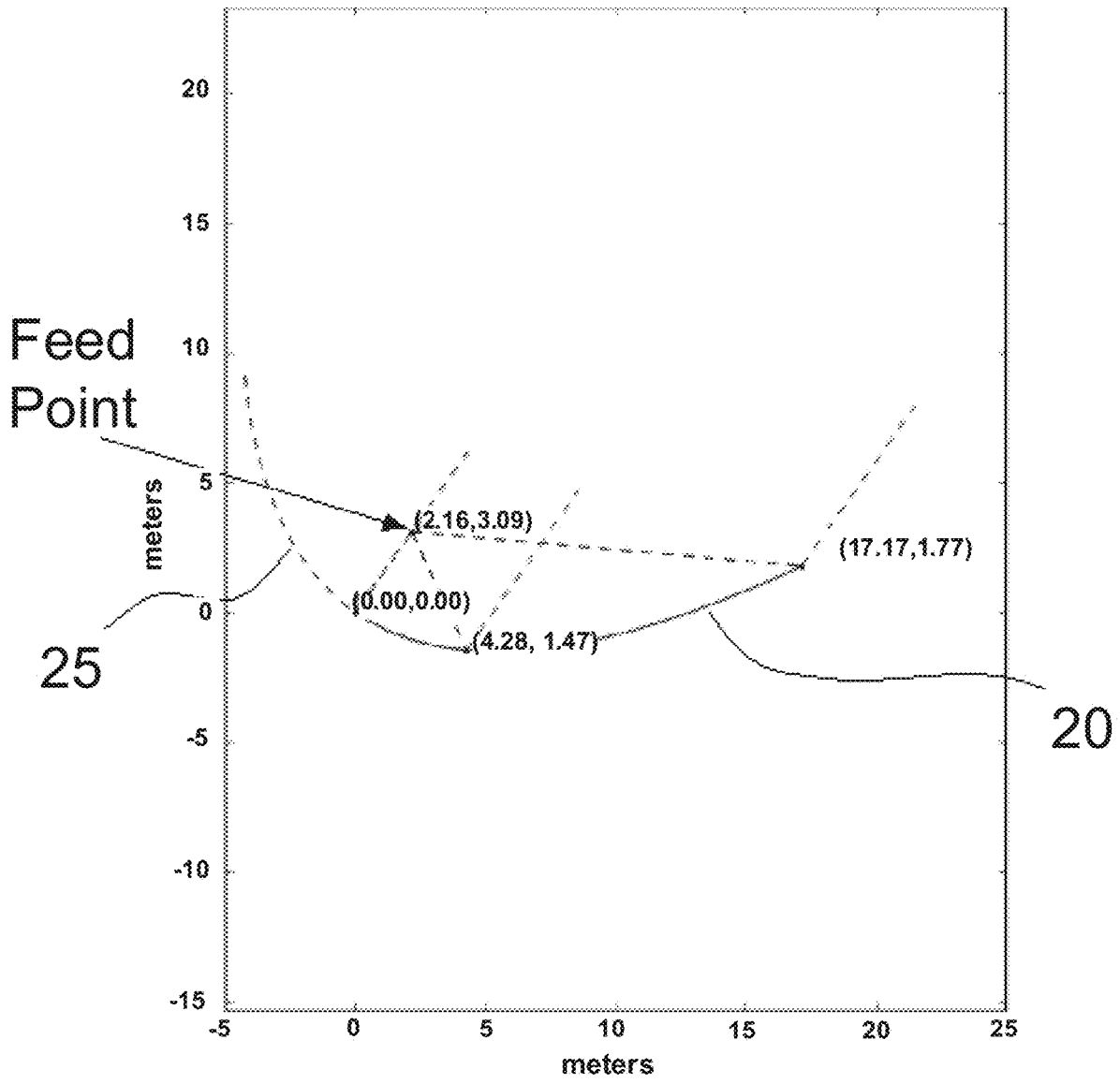

FIG. 19 shows another configuration where the feed points are rotated 55°. Here the feed points are about 3 m above and about 2 m away from the edge of the dish. Other offset configurations are also possible. These configurations lower the feed points as well as make it more accessible. These configurations also minimize the blockage caused by the feedpoints.

Given the physical size of the 1D system, there may be variations in the position of the elements. These variations may cause variations in the magnitude and phase of the receive and transmit signals. Variations in signals may also be caused by other factors unrelated to the size of the 1D system, such as cable characteristic, electronics, cross-coupling from signals emanating from neighboring elements. Ultimately, these variations may cause degradation of the beams by affecting the beam pattern and beam sensitivity. It may be advantageous to measure the variations and then accommodate for the variations.

The process of calibration may generally consist of at least two steps. In the first step, an electromagnetic model of the system, which included the geometry of the elements and the 1D trough, may be generated based on measuring the position of the elements from a reference point. These measurements can be made for example with a laser device or from multiple aerial photographs from multiple angles from which a 3D model of the system is built. A second step requires a calibration antenna located at a known position. Each element sends and receives signals from the calibration antenna one by one. Now the measured phase of the received signals is compared to the predicted phase from the model for each element. One should note that the electromagnetic model may also contain the location of the calibration antenna.

These deviations on an element-by-element basis provide the phase distortion or modification that occur due to the electronics and other factors. These deviation values, called calibration values, are obtained for transmit and receive operation separately. To obtain the transmit calibration values, the reverse of the above operation is performed; in other words, signals are transmitted from each element on an element-by-element basis and received at the calibration antenna. The appropriate transmit or receive values are then applied when the system is in operation again on an element-by-element basis.

For the purposes of satellite, spacecraft and space debris tracking, it is advantageous to measure the electron-density as a function of ionospheric depth. Electromagnetic waves travelling through the ionosphere can experience delays in the UHF band. This may lead to time-variable bases in the range measurements. To first order, the phase delay incurred by electromagnetic waves through the ionosphere is 40.3 TEC/f, where TEC is the total electron content (units of electrons per m2) and/is the operating frequency in Hz. Two-way range delays could be in the range of 10-100 meters, and highly variable because of variability in ionospheric conditions. This is especially true at mid and low latitudes where the ionosphere is most variable.

The conventional way to address this issue includes modeling the ionosphere and using the model to correct the range measurements. However, the ionospheric characteristics change as a function of location and time, reducing the value of using the model for error correction. In the method described below, the incoherent scatter resulting from transmitting measurement pulses is received and analyzed. By using the pulse and amplitude of the received signals, a real-time model of the ionosphere is generated. Use of this model may result in more accurate range estimates.

To explain this in mathematical terms, incoherent scatter (IS) is thermal backscatter from ionospheric electrons, as discussed by J. V. Evans in "Theory and Practice of Ionosphere Study by Thomson Scatter Radar," Proceedings of the IEEE, vol. 57, no. 4, pp. 496-530, 1060. The incoherent scatter backscatter cross-section is given in that paper as:

$$\sigma = \frac{\sigma_e}{(1+\alpha^2)(1+T_e/T_i+\alpha^2)} \quad \text{Eqn. 11}$$

where $\sigma_e$ is the radar cross-section of an electron, $T_e$ and $T_i$ are the electron and ion temperatures, and $\alpha$ is a wavelength-dependent plasma Debye-length term. The total received power is then proportional to the total number of electrons within the illuminated volume, and thus the electron number density $N_e$, as well as the power aperture product. The received power decreases as:

$$P_S \alpha P_t A_{eff} \frac{N_e \sigma}{R^2} \quad \text{Eqn. 12}$$

By analyzing the received power, ISRs can effectively profile the electron number density, as well as other properties of the medium through interpretation of the IS Doppler spectrum.

In practice, ionospheric probing pulses can be interleaved with the satellite tracking pulses to measure range-resolved profiles of the electron density. The ionospheric total electron content (TEC) between the transmitter and satellite can be computed by integrating the measured electron density along the path from the transmitter to the satellite. The range delay can be computed through the phase delay equation above.

As stated earlier, for communications applications, the anticipated deployment of low earth orbit (LEO) constellations consisting of multiple satellites requires high bandwidth communications to enable simultaneous communication with the satellites. These constellations may consist of hundreds of satellites per orbital plane, tens of satellites of which could be in view to a ground station at one time. The approach described here uses multiple receive beams to communicate to the multiple satellites simultaneously.

Figure 20:
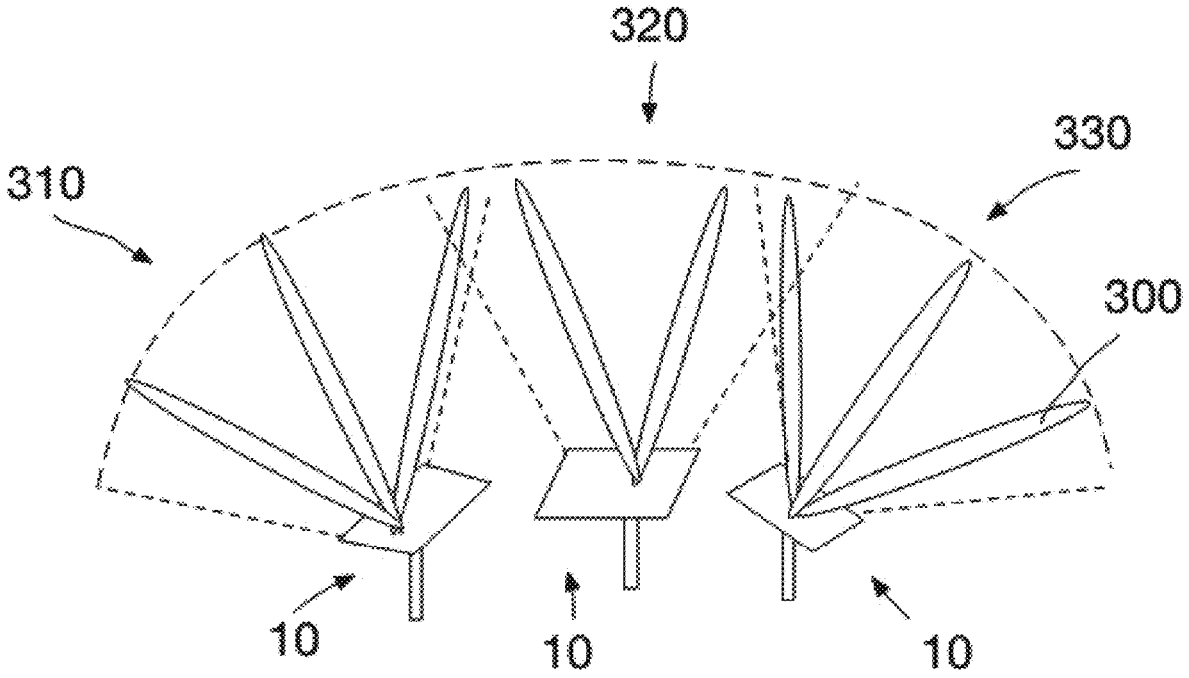
FIG. 20 shows multiple beams.

FIG. 20 illustrates a configuration where multiple beams are generated. This is an advantageous configuration for a communications system with the requirement to uplink and/or downlink with multiple satellites simultaneously. In this example, three 1D systems are illustrated although the multiple beams can be generated with just one system. The imaging field-of-view of each 1D system is illustrated by 310, 320, and 330. By arranging the systems in a plane, a composite field-of-view in the X-Z plane may be created and multiple satellites in the same orbital plane can be addressed.

In some applications such as for communications, it may be advantageous to use different frequency bands. For example, the S-band (2-4 GHz) may be used for uplink and X-band (8-12 GHz) may be used for the downlink. For reference, uplink refers to the communication between the ground stations to the satellites and downlink refers to the communication from the satellite to the ground stations. Some protocols for downlinking data from satellites require that an uplink be established and maintained during the download. This is done to obtain information about the quality of the link and to determine the data rate to be used for the downlink. The uplink requires only a low data rate, for example, often a narrow bandwidth beam (about 1-2 MHz) is sufficient for the uplink. For the downlink, a wider bandwidth is often necessary. For example, an appropriate bandwidth may be around 100 MHz.

Other frequencies and bandwidths are possible for the uplink and downlink. For example, the Ku band (12-18 GHz) may be used for the uplink and the Ka band (26.5-40 GHz) may be used for the downlink. There are a number of ways the antennas for the two different bands can be configured in the context of a 1D system. In one configuration, the two 1D phased arrays are arranged so that they are horizontally offset. This is illustrated in FIG. 9A.

Figure 21:
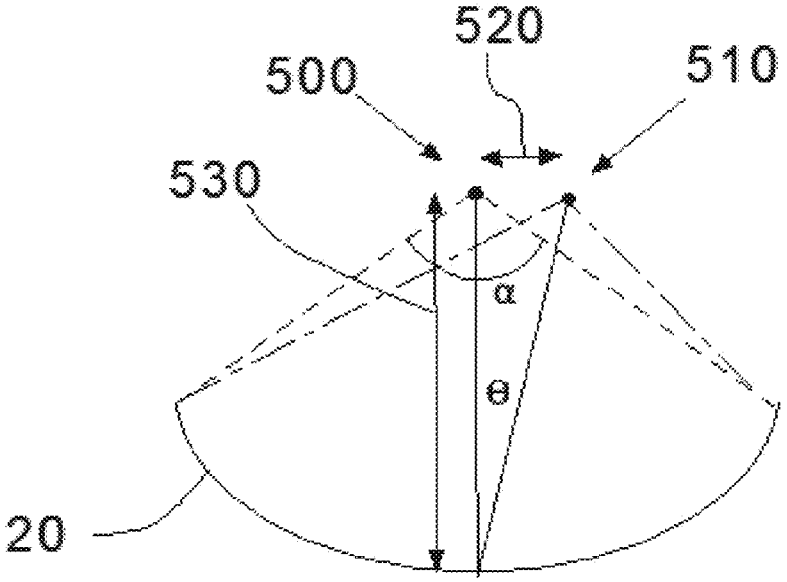
FIG. 21 shows an embodiment of a dual band system with horizontal offset.

In FIG. 21 the location indicated by 500 may be the location of the X-band downlink feed whereas the location indicated by arrow 510 may be the location of the S-band uplink feed. Arrow 520 indicates the distance by which the S-band is offset. In this case the X-band feed is placed at the focus point of the trough and the S-band is horizontally offset. Various rules may be used to calculate the amount of horizontal offset shown at 520. However, one preferred configuration is to place the higher frequency antenna at the focus and offset the lower frequency antenna and make this offset to equal ¼ (X-band wavelength+S-band wavelength), which effectively places the feeds side by side. Feeds are often half a wavelength in width.

Moving the feed away from the focus degrades the performance of the system; however, the system performance degrades more slowly at lower frequencies. So the high frequency feed is placed at the optimal location and the low frequency feed is placed nearby. This configuration ensures that the higher frequency signals are minimally or not impacted, but the signals from the low frequency may be lower at the target due to the misalignment of the antenna from the feed. A standard engineering design rule is to accept a maximum of 3 dB of degradation, but less degradation is preferable.

If the downlink frequency is chosen as 8.1 GHz, having a wavelength of 3.7 cm, in the X-band, and the uplink frequency is chosen as 2,056 GHz, having a wavelength of 15 cm, in S-band, then the maximum offset causing 3 dB of degradation to the uplink system is 4.6 cm. In addition to degrading system performance, offsetting the feed changes the pointing direction of the main beam. If the changes are large enough, then the antenna will not point at the satellite but instead at blank sky nearby. For example, given the offset of 4.6 cm above and a trough width of 2 meters, Table 2 below shows the change in pointing direction of the S-band beam in degrees (θ) for various focal heights shown as 530. The table also shows what the X-band feed angle in degrees (α) is for these focal heights.

The feed angle is the width of the trough, measured as an angle, when viewed from the location of the feed. The system will perform best when the beam width of the feed equals the feed angle of the trough, otherwise the trough is over-illuminated that wastes energy or under-illuminated which does not maximally utilize the trough. A beam width of 90° is common for commercially available feeds. Changing the curvature of the trough, from the X-band example discussed above, so that the feed angle is 90° results in an optimal focal height of 1.2 m.

TABLE 2

| Focal height (m) 530 | S-band beam offset (deg) θ | X-band feed angle (deg) α |
|---|---|---|
| 1 | 2.62 | 106 |
| 1.2 | 2.18 | 90 |
| 1.25 | 2.09 | 87 |
| 2 | 1.31 | 56 |
| 2.5 | 1.05 | 45 |
| 3 | 0.87 | 38 |

Figure 22:
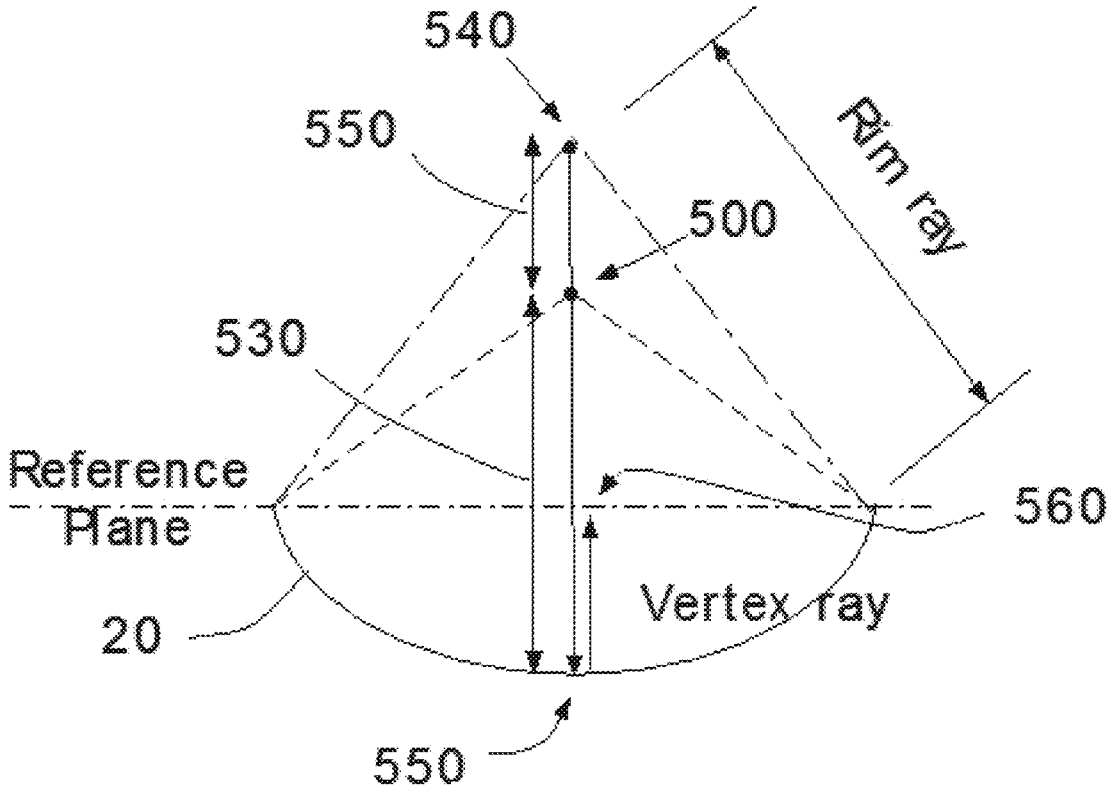
FIG. 22 shows an embodiment of a dual band system with vertical offset.

In an alternative configuration, the S-band antenna may be offset vertically from the X-band antenna, which would be placed at the focus of the reflector. FIG. 22 illustrates this situation. The S-band antenna is placed at location 540 whereas the X-band antenna is placed at location 500, The vertical offset is indicated by arrow 550 and as before, the focal height is indicated by 530. Various rules may be used to calculate the amount of vertical offset 550. However, in one preferred configuration, the vertical offset is chosen such that the path length difference between the rim ray and the vertex ray, path length between 540 to 550 and back up to 560, is 90°. This condition ensures that the reflected ray coming from the edge of the reflector and from location 560 interfere neither constructively or destructively. Rays emanating from all other points interfere more and more constructively.

In yet another alternative configuration, the 1D system can be made in sections and each section may have only one type of feed antenna. This is the case of the ID communications system having three sections, the middle section may be the X-band and the outer two sections can be the S-band.

In another configuration a dichroic sub-reflector is placed between the trough and the prime focus 500 in FIG. 22 along the line segment connecting 500 and 550 in FIG. 9B. One feed may be placed at the prime focus and the other feed may be placed to the side of the trough, behind the trough, or between the trough and the dichroic reflector. If the second feed is behind the trough, then a hole must be formed in the trough to allow radio frequency energy to pass between the sub-reflector and the feed. The dichroic sub-reflector may be designed to be transparent at the frequency of first feed, so the first feed sees the trough as if the sub-reflector were not present. Furthermore, the dichroic sub-reflector may be designed to be highly reflective at the frequency of the second feed. The sub-reflector redirects the energy to focus at a new point at a different location than the prime focus of the trough. This creates two focus points for the system, each at a distinct frequency and location, so that the performance of both feeds may be optimize and the feeds do not need to be located close to one another.

It can now be seen that several techniques exist that allow placement if different types of antenna in the same reflector. The preferred configuration is to use two sections—one section dedicated to the uplink and the other section dedicated to the downlink—with all the feeds placed at the optimum locations, the focus points. This is done because using offset feeds can be a very expensive design challenge. Placing feeds side-by-side or one-behind-the-other can lead to electromagnetic coupling and radio frequency interference, whereby signals from the transmit system (uplink) corrupt the receive system (downlink). The additional design cost for offset feeds is often larger than simply building multiple troughs.

Given a set of requirements for signal integrity for any one or a group of satellites, a consistent approach may be adopted to design the length and width of the trough antenna. As an example, given the requirements of the link quality, the total collecting area of the trough may be determined. Similarly, the orbital plane of the satellites may be used to determine the width of the antenna as the width determines the width of the elevation beam. The choice of the width and the size of the elevation beam may be such that the satellite always remains with the scanning plane of the 1D system. With the width and collecting area calculated as described above, the length of the trough may be determined.

The 1D systems described above may be configured as part of a satellite control system. In one application of this control system, the system may be used to send alerts when expected targets do not get detected. This may happen for example when satellites drift from their orbits. In particular, low altitude satellites are more prone to drifting due to atmospheric drag. When a satellite is expected but not detected, alerts can be sent out to the operators. In addition, the scanning pattern of the 1D system may be modified to try and find the satellite. For example, the field-of-view may be broadened to a larger angle so that more area is covered. In addition, if the system was mounted on a mobile platform particularly if the system was operating in the S-band, K-band or X-band when the size of the trough would be of the order of a few meters, then the 1D system may be repositioned in one of various ways to try and find the satellite. In addition, one should note that while the above discussion has been directed to 1D phased arrays, the discussion also applies to 2D phased arrays.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A system comprising:

a 1D phased array radar including a parabolic trough reflector, a support structure, and a set of housings positioned on the support structure, wherein each housing of the set of housings includes a transmitter and a receiver, wherein each transmitter of each housing of the set of housings is configured to transmit a signal to the parabolic trough reflector such that that the parabolic trough reflector reflects the signal towards a space object, wherein each receiver of each housing of the set of housings is configured to receive a reflection of the signal off the space object as reflected via the parabolic trough reflector, wherein the 1D phased array radar includes a sub-reflector extending between the set of housings and the parabolic trough reflector.

2. The system of claim 1, wherein the parabolic trough reflector includes a mesh.

3. The system of claim 2, wherein the mesh has an aperture size, wherein the 1D phased array radar has an operating wavelength, wherein the aperture size is smaller than the operating wavelength.

4. The system of claim 1, wherein each of the signals is digitized.

5. A system comprising:

a set of 1D phased array radars, each 1D phased array radar of the set of 1D phased array radars includes a parabolic trough reflector, a support structure, and a set of housings positioned on the support structure, wherein each housing of the set of housings includes a transmitter and a receiver, wherein each transmitter of each housing of the set of housings is configured to transmit a signal to the parabolic trough reflector such that that the parabolic trough reflector reflects the signal towards a space object, wherein each receiver of each housing of the set of housings is configured to receive a reflection of the signal off the space object as reflected via the parabolic trough reflector, wherein set of 1D phased array radars is deployed to scan a set of sky sections based on the signals, wherein the set of 1D phased array radars is configured to detect the space object at least twice based on the signals when the space object passes the set of sky sections.

6. The system of claim 5, wherein the set of 1D phased array radars is collocated.

7. The system of claim 5, wherein the set of sky sections are different from each other in orientation.

8. The system of claim 5, wherein the space object is an orbiting space object, wherein the set of 1D phased array radars is configured to detect the space object in any orbit based on the signals when the space object passes the set of sky sections.

9. The system of claim 5, wherein the set of 1D phased array radars is not collocated.

10. The system of claim 5, wherein at least one parabolic trough reflector includes a mesh.

11. The system of claim 10, wherein the mesh has an aperture size, wherein at least one respective 1D phased array radar has an operating wavelength, wherein the aperture size is smaller than the operating wavelength.

12. The system of claim 5, wherein each of the signals in at least one 1D phased array radar of the set of 1D phased array radars is digitized after a beam summation based on the signals.

13. The system of claim 5, wherein at least one 1D phased array radar of the set of 1D phased array radars includes a sub-reflector extending between the set of housings and the parabolic trough reflector.

14. A method comprising:

receiving, by a processor, a set of data from a set of 1D phased array radars, each 1D phased array radar of the set of 1D phased array radars includes a parabolic trough reflector, a support structure, and a set of housings positioned on the support structure, wherein each housing of the set of housings includes a transmitter and a receiver, wherein each transmitter of each housing of the set of housings is configured to transmit a signal to the parabolic trough reflector such that that the parabolic trough reflector reflects the signal towards a space object, wherein each receiver of each housing of the set of housings is configured to receive a reflection of the signal off the space object as reflected via the parabolic trough reflector, wherein set of 1D phased array radars is deployed to scan a set of sky sections based on the signals, wherein the set of data is informative of the set of 1D phased array radars detecting the space object based on the signals at least twice as the space object passes the set of sky sections; and taking, by the processor, an action based on the set of data.

15. The method of claim 14, wherein at least two sky sections in the set of sky sections are different from each other in orientation.

16. The method of claim 14, wherein the set of 1D phased array radars is collocated.

17. The method of claim 14, wherein the set of 1D phased array radars is not collocated.

* * * * *